US006353410B1

(12) United States Patent
Powell

(10) Patent No.: US 6,353,410 B1
(45) Date of Patent: Mar. 5, 2002

(54) SPACE TAPERED ANTENNA HAVING COMPRESSED SPACING OR FEED NETWORK PHASE PROGRESSION, OR BOTH

(75) Inventor: Charles M. Powell, Plainsboro, NJ (US)

(73) Assignee: Radio Frequency Systems, Inc., Marlboro, NJ (US)

( * ) Notice: Subject to any disclaimer, the term of this patent is extended or adjusted under 35 U.S.C. 154(b) by 0 days.

(21) Appl. No.: 09/273,113

(22) Filed: Mar. 19, 1999

(51) Int. Cl.[7] ..... H01Q 3/22
(52) U.S. Cl. ..... 342/373; 342/368
(58) Field of Search ..... 342/368, 372, 342/373, 446; 343/793, 820, 825, 828, 792.5, 810–814

(56) References Cited

U.S. PATENT DOCUMENTS 4,086,598 A 4/1978 Bogner
5,589,843 A * 12/1996 Meredith et al. ..... 343/820
6,072,432 A * 6/2000 Powell et al. ..... 342/373

* cited by examiner

*Primary Examiner*—Bernarr E. Gregory
(74) *Attorney, Agent, or Firm*—Ware, Fressola, Van Der Sluys & Adolphson LLP

(57) ABSTRACT

A space-tapered antenna has a collinear array of radiating elements coupled via a cable feeding system to a Butler matrix feed system. Either the collinear array has compressed rows spaced in a range of ⅜ to ¼ λ, where λ is the operating wavelength of the antenna, the cable feeding system is a phase progression cable feeding system, or both. One 120° space-tapered antenna has eight compressed rows spaced at ⅜ λ for providing six 20° degree beams with −10 dB side lobe suppression. Another 120° space-tapered antenna has eight compressed rows spaced at ¼ wavelength for providing four 30° beams with −15 dB side lobe suppression. A 60° space-tapered antenna has eight compressed rows spaced at ⅜ λ in combination with a 22 ½° phase progression cable feeding system for providing three 20° beams with −14 dB side lobe suppression. One 90° space-tapered antenna has eight compressed rows spaced at ¼ λ in combination with a 22 ½° phase progression cable feeding system for providing three 30° beams with −17 dB side lobe suppression. Another 90° space-tapered antenna has four rows spaced at ½ λ and a 45° phase progression cabling feeding system for providing three 30° beams with −12 dB side lobe suppression.

10 Claims, 32 Drawing Sheets

(Antenna #1)

(Antenna #2)

(Antenna #3)

(Antenna #4)

(Antenna #4')

SPACE TAPERED ANTENNA HAVING COMPRESSED SPACING OR FEED NETWORK PHASE PROGRESSION, OR BOTH

BACKGROUND OF THE INVENTION

1. Technical Field

This invention relates to an antenna; and more particularly relates to a multibeam antenna.

2. Description of Related Art

FIG. 1A shows an antenna 20 of U.S. Pat. No. 5,589,843 having a space tapered multi-beam antenna 24, a Butler-matrix feed network 28, and a radio receiver and/or transmitter 37. The antenna 20 is known as a space tapered one hundred twenty degree antennas having four thirty degree beams.

The radio receiver and/or transmitter 37 receives and/or provides radio receiver and/or transmitter signals from or to the 4-way Butler matrix feed network 28 via cabling 41. The radio receiver/transmitter equipment 37 is generally shown since the specific type of equipment used in an actual installation can vary widely. The Butler matrix feed network 28 is implemented using a planar microstrip design 39 shown in FIG. 1B with no crossovers and is fabricated from a printed circuit board having a dielectric substrate made of low loss ceramic material, such as glass epoxy. In general, the Butler-matrix feed network 28 has N antenna ports 29 and N receiver/transmitter equipment ports 31, where N is equal to the number of co-linear arrays of the associated antenna. As shown, the 4-way Butler matrix feed network 28 has four antenna output ports 29 and four radio receiver/transmitter input ports 31. The standard phase shift of the 4-way Butler matrix feed network 28 is as follows:

| | ANT1 | ANT2 | ANT3 | ANT4 |
|---|---|---|---|---|
| BEAM 2L | 0 | −135 | +90 | −45 |
| BEAM 1L | 0 | −45 | −90 | −135 |
| BEAM 1R | 0 | +45 | +90 | +135 |
| BEAM 2R | 0 | +135 | −90 | +45 |

The Butler-matrix feed network 28 is connected to the space-tapered antenna 24 with equally phased cables 35 that provide phase shifting of outgoing signals to electronically steer the radiating pattern of the space-tapered antenna 24.

In FIG. 1A, the space tapered multi-beam antenna 24 has a space-tapered array 26 (ANT1, ANT2, ANT3, ANT4) with rows of radiating elements spaced at about ½ λ (i.e. wavelength), where λ is the wavelength of the electromagnetic energy to be received or transmitted. (In practice, the spacing between adjacent co-linear arrays may actually be approximately 0.47 λ.) The number of radiating elements in outermost rows is less than the number of radiating elements in center rows in order to suppress side-lobes distortion in the antenna signal, which is typically −9 or −10 Db. The space-tapered array 26 includes four co-linear arrays of associated electromagnetic radiating elements 30. Each antenna output port 29 of the 4-way Butler matrix feed network 28 is respectively connected to a respective antenna ANT1, ANT2, ANT3, ANT4 of the co-linear array 26 by cables 35 and connectors 27 associated with each antenna array. The cables 35 are all the same length (i.e. equal phase cables) so as not to introduce any phase change with respect to the signals carried thereover relative to the other cables 35. In comparison, the cables 41 need not be equal phase cables since any phase changes introduced by these cables is not relevant to the electronic beam(s) being used.

In FIG. 1A, the outermost co-linear antenna arrays ANT1 and ANT4 each comprise two radiating elements 30, while the innermost antenna arrays ANT2 and ANT3 each comprise four radiating elements 30. These radiating elements 30 are typically dipole elements, although other types of radiating element can be used. Energy is radiated or received from these dipole elements by means of a feedstrap 43 having a centrally located connector 27. The dipole elements are spaced from each adjacent dipole element of the same array by a distance approximately equal to λ. The feed strap includes portions 45 extending beyond the lowermost and uppermost dipole element, with the end of these portions connected to the electrically conductive back plate 47 of the antenna. Such a feed strap configuration is known in the art as a Bogner type feed (see U.S. Pat. No. 4,086,598, hereby incorporated by reference).

The phase progression for the antenna beam of the antenna shown in FIG. 1A is show in the table below:

| BEAM | ANT1 | ANT2 | ANT3 | ANT4 |
|---|---|---|---|---|
| 2L | 0 | −135 | +90 | −45 |
| 1L | 0 | −45 | −90 | −135 |
| 1R | 0 | +45 | +90 | +135 |
| 2R | 0 | +135 | −90 | +45 |

The one hundred twenty degree antennas 20 suffer from high side-lobe levels that do not meet desired customer specifications of being below −10 dB from the beam peak. Also, the outer beams suffer from a drop in gain as compared to the inner beams.

FIGS. 1C, 1D, 1E show frequency plots for the antenna 20 in FIG. 1A that show these problems, including frequency plots respectively at frequencies of 1.850 giga Hertz (hereinafter "GHz"), 1.920 GHz and 1.990 GHZ. As a person skilled in the antenna design art would appreciate, each plot shows various plot characteristics, including four plot overlays (i.e. 1LH, 1RH, 2LH, 2RH), four beam peaks in degrees, four beamwidths in degrees, four front-to-back (hereinafter "f/b") ratios in decibels (hereinafter "dB") and four sidelobes in degrees and dBs. In FIGS. 1C, 1D, 1E, the various "triangles" help to indicate these various plot characteristics.

The technical problem to be solved is to provide an antenna having reduced side-lobe suppression, including a spaced-tapered antenna having outer beam signals that do not have a significant drop in gain as compared to inner beam signals.

SUMMARY OF THE INVENTION

The basic idea of the present invention is to either compress the row spacing of radiating elements in the collinear arrays of the antenna, or use phase progression cables leading from the feed system to the collinear array, or both.

The invention provides a new antenna, including a space-tapered antenna, having a collinear array of radiating elements coupled via a cable feeding system to a Butler matrix feed system. In the antenna, either the collinear array has compressed rows spaced in a range of ⅜ to ¼ of a wavelength, the cable feeding system is a phase progression cable feeding system, or both.

One 120° space-tapered antenna has eight compressed rows spaced at ⅜ wavelength for providing six 20° degree beams with −10 dB side lobe suppression. The six beam antenna is unique in that it provides a way to use an 8-way Butler matrix, because in the prior art there is no 6-way Butler matrix feed system.

Another 120° space-tapered antenna has eight compressed rows spaced at ¼ wavelength for providing four 30° beams with −15 dB side lobe suppression.

A 60° space-tapered antenna has eight compressed rows spaced at ⅜ wavelength in combination with a 22 ½° phase progression cable feeding system for providing three 20° beams with −14 dB side lobe suppression.

A 90° space-tapered antenna has eight compressed rows spaced at ¼ wavelength in combination with a 22 ½° phase progression cable feeding system for providing three 30° beams with −17 dB side lobe suppression.

A 90° space-tapered antenna has four rows spaced at ½ wavelength and a 45° phase progression cabling feeding system for providing three 30° beams with −12 dB side lobe suppression. For this antenna, the phase progression shifts the beams so that a center beam is down the middle, normal to the antenna. This also reduces the number of beams by one such that the radiating pattern of the antenna includes the center beam with an equally balanced number of side beams around the center beam. The phase progression may also be achieved directly in the output of the feed network.

One advantage of the present invention includes improved side-lobe distortion suppression and reduced dropoff in gain of the outer beams as compared to the inner beams. The sidelobe distortion is reduced by about −6 dB which translates into 4× less side lobe distortion in the antenna signal for improved signal transmission.

These embodiments provides improved side-lobe suppression and the outer beams that do not have the gain dropoff associated with prior art space tapered antennas.

A DESCRIPTION OF THE DRAWINGS

For a fuller understanding of the nature of the invention, reference should be made to the following detailed descriptions taken in connection with the accompanying drawings, not in scale, in which:

FIG. 1A shows a prior art antenna 20 shown and described in U.S. Pat. No. 5,589,843.

DETAILED DESCRIPTION OF THE INVENTION

Figure 1A:
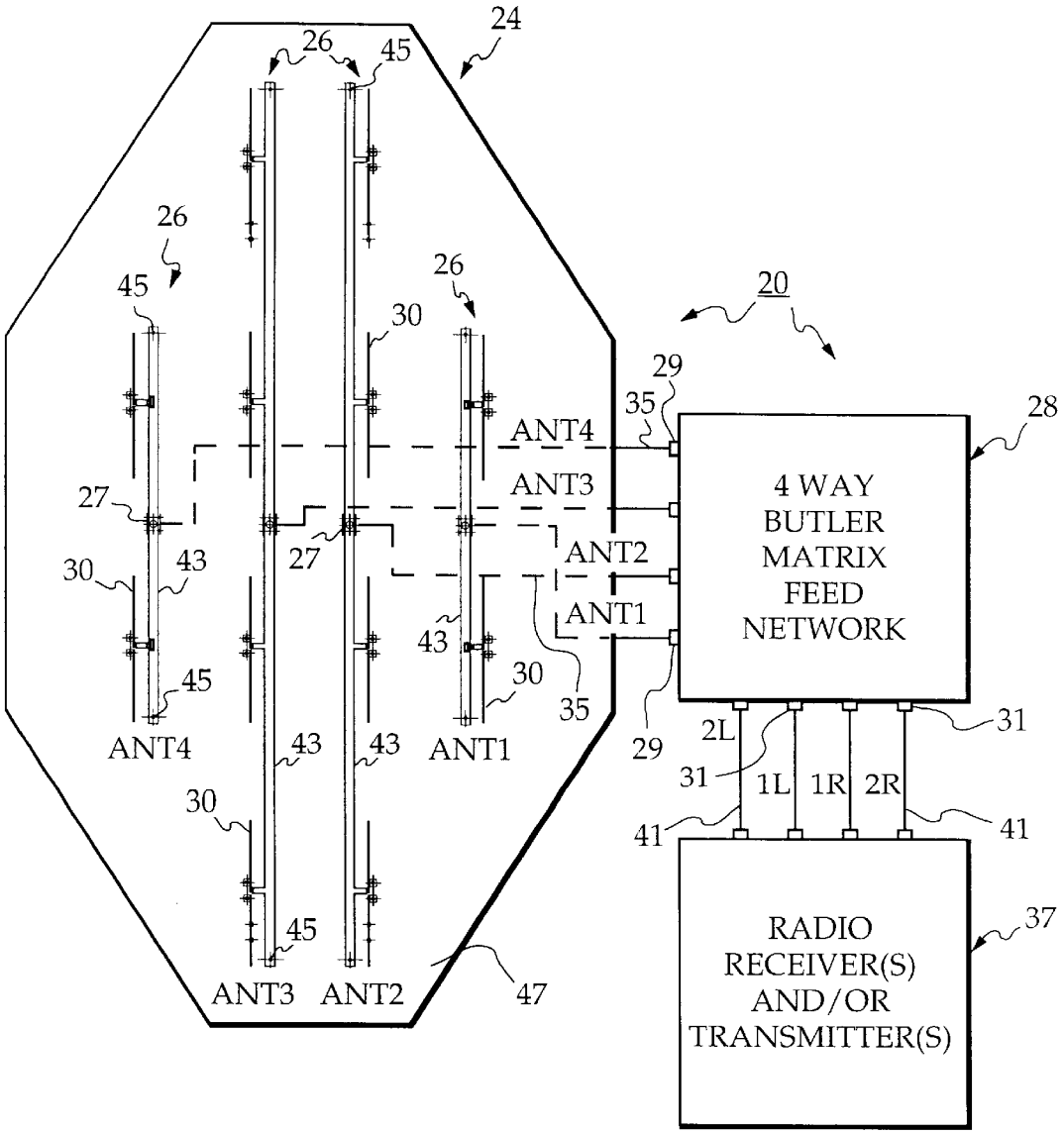
FIG. 1A (PRIOR ART)
FIG. 1B shows a 4-way Butler matrix feed network 28 that is part of the antenna 20 shown in FIG. 1A.
FIGS. 1C, 1D, 1E show frequency plots for the antenna 20 in FIG. 1A respectively at frequencies of 1.850 GHz, 1.920 GHz and 1.990 GHZ.
Figure 1B:
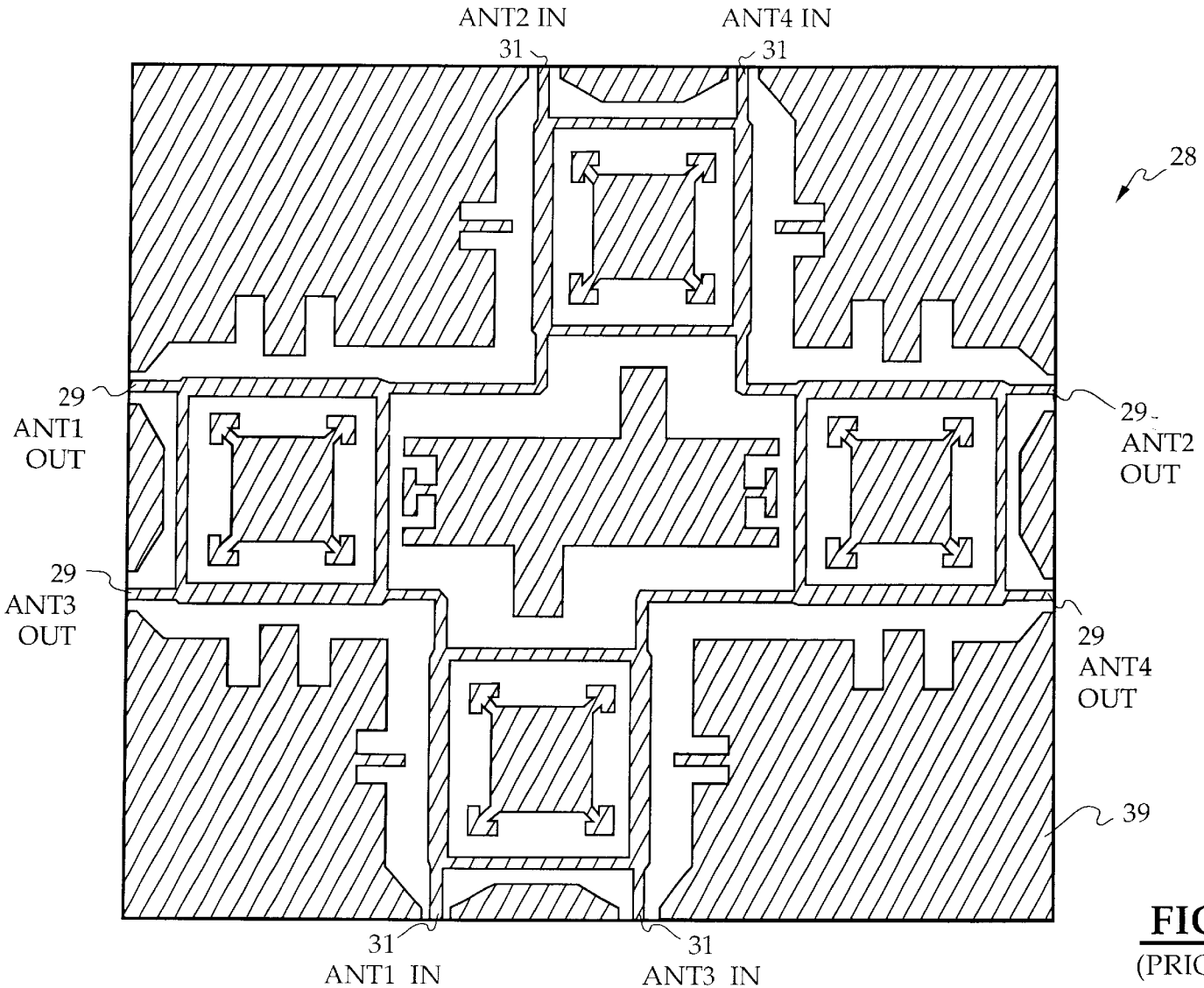
FIG. 1B (PRIOR ART)

Various embodiments of the invention will be described below. For the convenience of the reader, and to the extent possible, the reference numeral system used to describe embodiments of the present invention will substantially track the numeral system used to describe the antenna shown in FIG. 1A with the addition of multiples of 100s.

Space Tapered 90° Multi-beam Antenna with Three 30° Beams

Figure 2A:
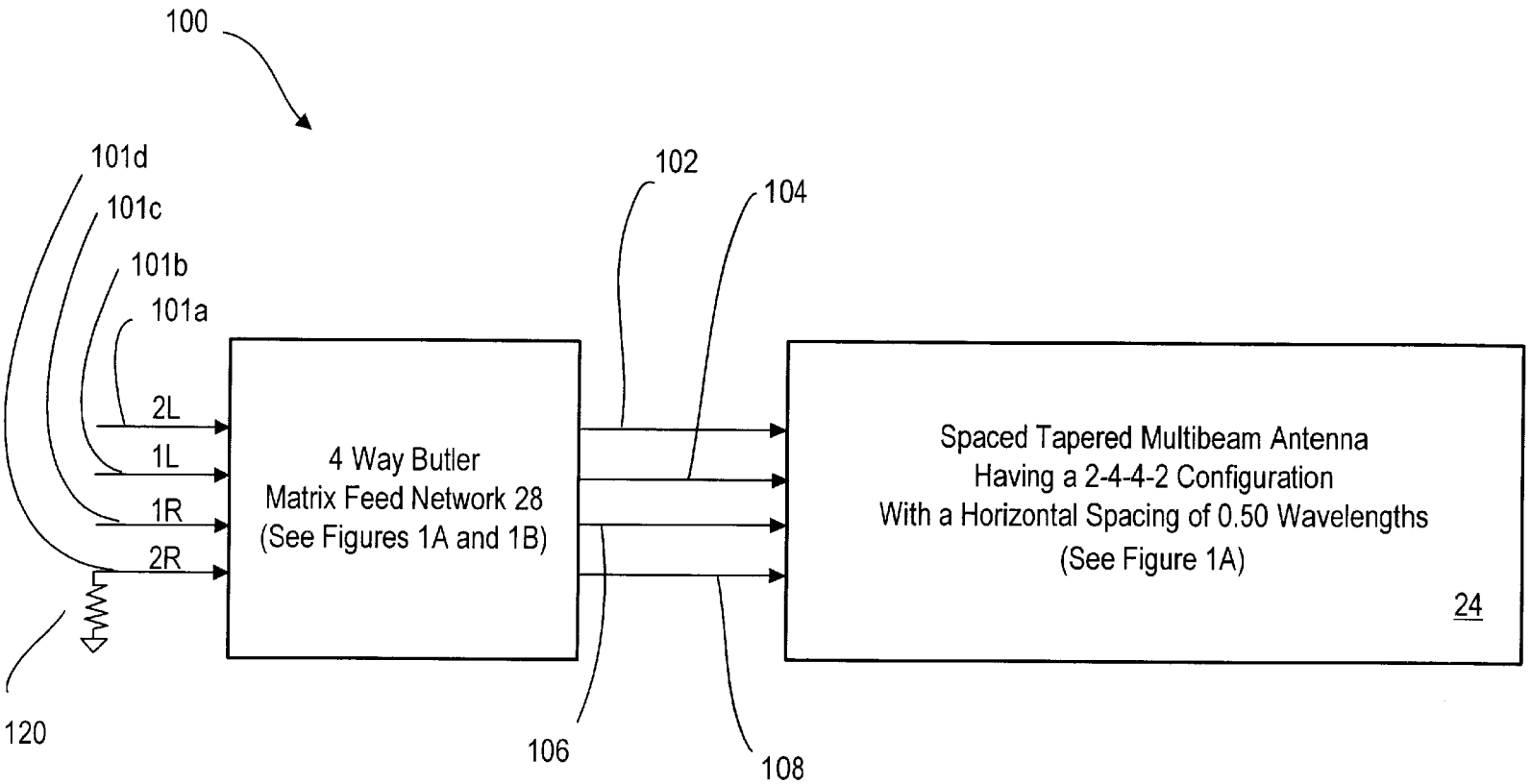
FIG. 2A shows a block diagram of an antenna that is the subject matter of the present invention.

FIG. 2A shows a ninety degree antenna generally indicated as 100 having a 4-way Butler matrix feed network 28 similar to that shown in FIG. 1A, having a space tapered multibeam antenna 24 with a 2-4-4-2 configuration and a horizontal spacing of 0.50 λ similar to that shown in FIG. 1A, and also having four cables 102, 104, 106, 108 with different cable lengths for connecting the 4-way Butler matrix feed network 28 to the space tapered multibeam antenna 24. The ninety degree antenna 100 provides three thirty degree beams.

In effect, the ninety degree antenna 100 works similar to the principles used on the four beam antenna 20 shown and described with respect to FIG. 1A. The space tapered multibeam antenna 24 and the 4-way Butler matrix feed network 28 remain the same as before. As shown, the 4-way Butler matrix feed network 28 has four input ports 101*a*, 101*b*, 101*c*, 101*d*. Only three of the four input ports 101*a*, 101*b*, 101*c* receive antenna input signals from the radio receiver and/or transmitter (not shown). The other input port 101*d* is connected via a resistor 120 to electrical ground. In one embodiment, the resistor 120 is 50 ohm resistors, although the scope of the invention is not intended to be limited to any particular resistor value. The only other change is the cabling that feed the Butler matrix signal to the space tapered multibeam antenna 24, as discussed below. In FIG. 1A, the cables 35 are equally phased. Similar in structure to cable 35 in FIG. 1A, each cable 102, 104, 106, 108 connects a respective antenna array ANT1, ANT2, ANT3, ANT4 (see FIG. 1A) to a respective Butler matrix output port 29 (see FIG. 1A). However, in contrast to the cables 35 in FIG. 1A, each cable 102, 104, 106, 108 has a different length to introduce a phase progression in the antenna signals provided to the respective antenna array ANT1, ANT2, ANT3, ANT4(see FIG. 1A). When the cables 102, 104, 106, 108 have a respective different length to provide a phase progression of forty-five degrees (i.e. 0, +45, +90, +135), then the antenna 100 will get the following "total" phase progression:

| BEAM | ANT1 | ANT2 | ANT3 | ANT4 |
|---|---|---|---|---|
| 1L | 0 | −90 | −180 | +90 |
| 1R | 0 | +90 | +180 | −90 |
| C | 0 | 0 | 0 | 0 |

Figure 2B:
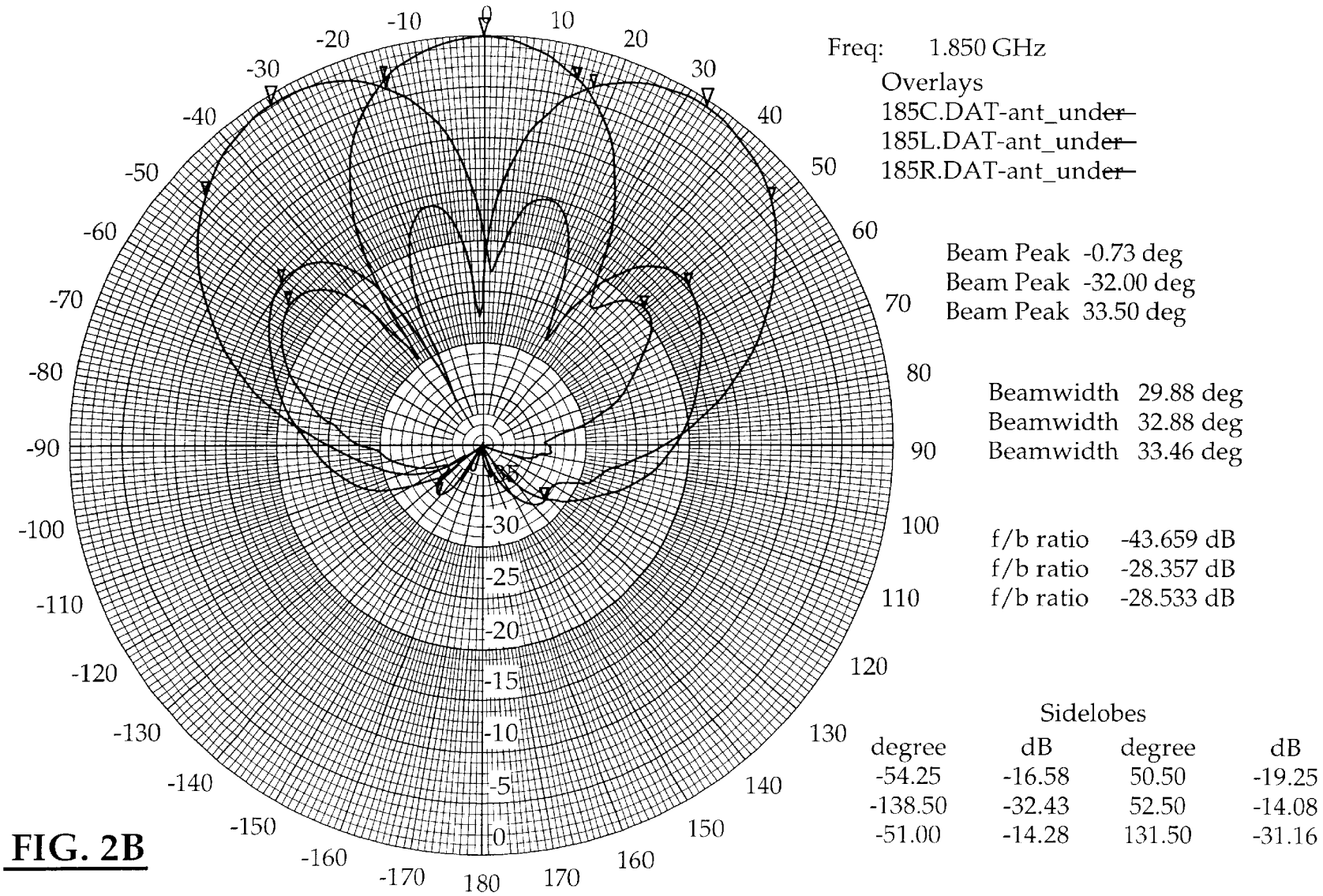
FIGS. 2B, 2C, 2D show plots for the antenna in FIG. 2A respectively at frequencies of 1.850 GHz, 1.920 GHz and 1.990 GHZ.
Figure 2C:
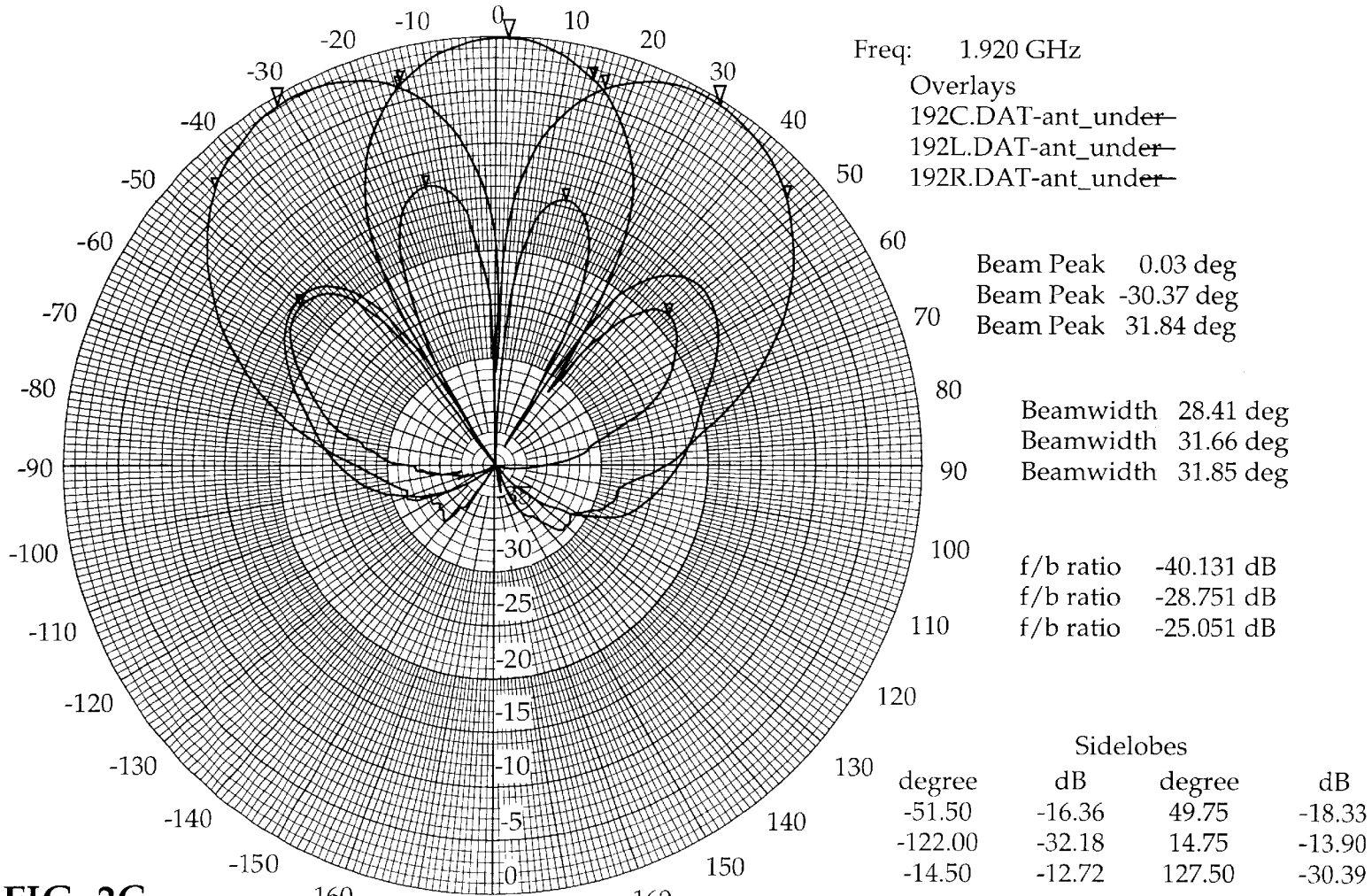
Figure 2D:
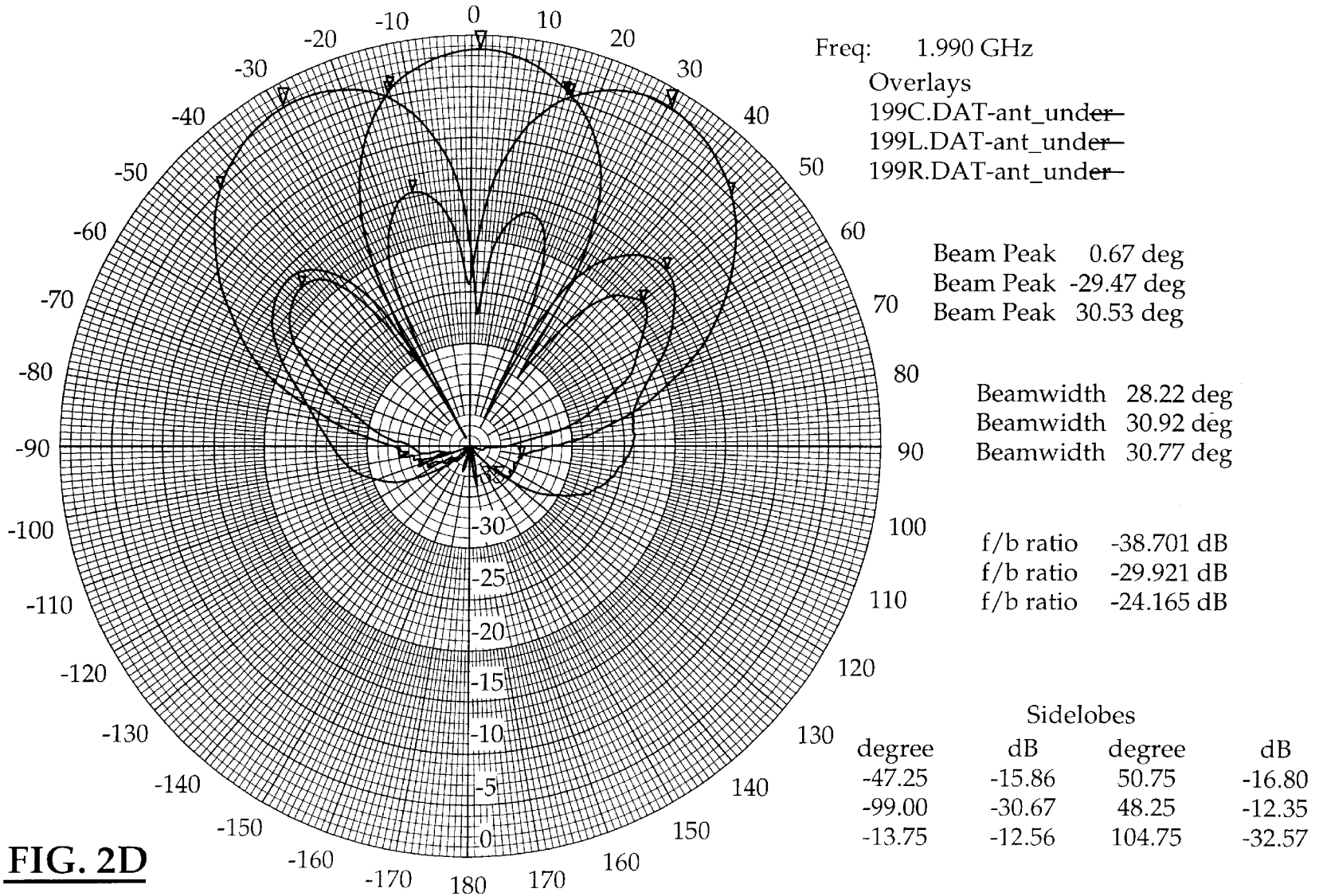

FIGS. 2B, 2C, 2D show frequency plots for the antenna in FIG. 2A respectively at frequencies of 1.850 GHZ, 1.920 GHz and 1.990 GHZ. As a person skilled in the antenna design art would appreciate, each plot shows various plot characteristics, including four plot overlays (i.e. Center, Left, Right), three beam peaks in degrees, three beamwidths in degrees, three f/b ratios in dB and three sidelobes in degrees and dBs. In FIGS. 2B, 2C, 2D, the various "triangles" help to indicate these various plot characteristics.

In operation, beams 2L, 1L, 1R are steered to become beams 1L, C, and 1R respectively. As shown, beam 2R is not used and is terminated with a fifty ohm load. In essence, the beams are steered fifteen degrees in order to get the center beam. Another way to get the extra phase is to add the phase progression directly onto the Butler's outputs.

The scope of the invention is not intended to be limited to any particular phase progression or cable lengths. A person skilled in the art would appreciate how to determine the different cable lengths to achieve the desired phase progression, which would typically depend may on the cable type and the frequency.

One advantage of the ninety degree antenna 100 is that it has side-lobe suppression better than −12 dB. The outer beams do not have the gain drop off associated with the one hundred twenty degree antenna when compared to the frequency plots shown in FIGS. 1C, 1D, 1E.

The ninety degree antenna 100 can be used wherever the original four beam antenna 20 in FIG. 1A is used.

Space Tapered 120° Multi-beam Antenna With Six 20° Beams

Figure 3A:
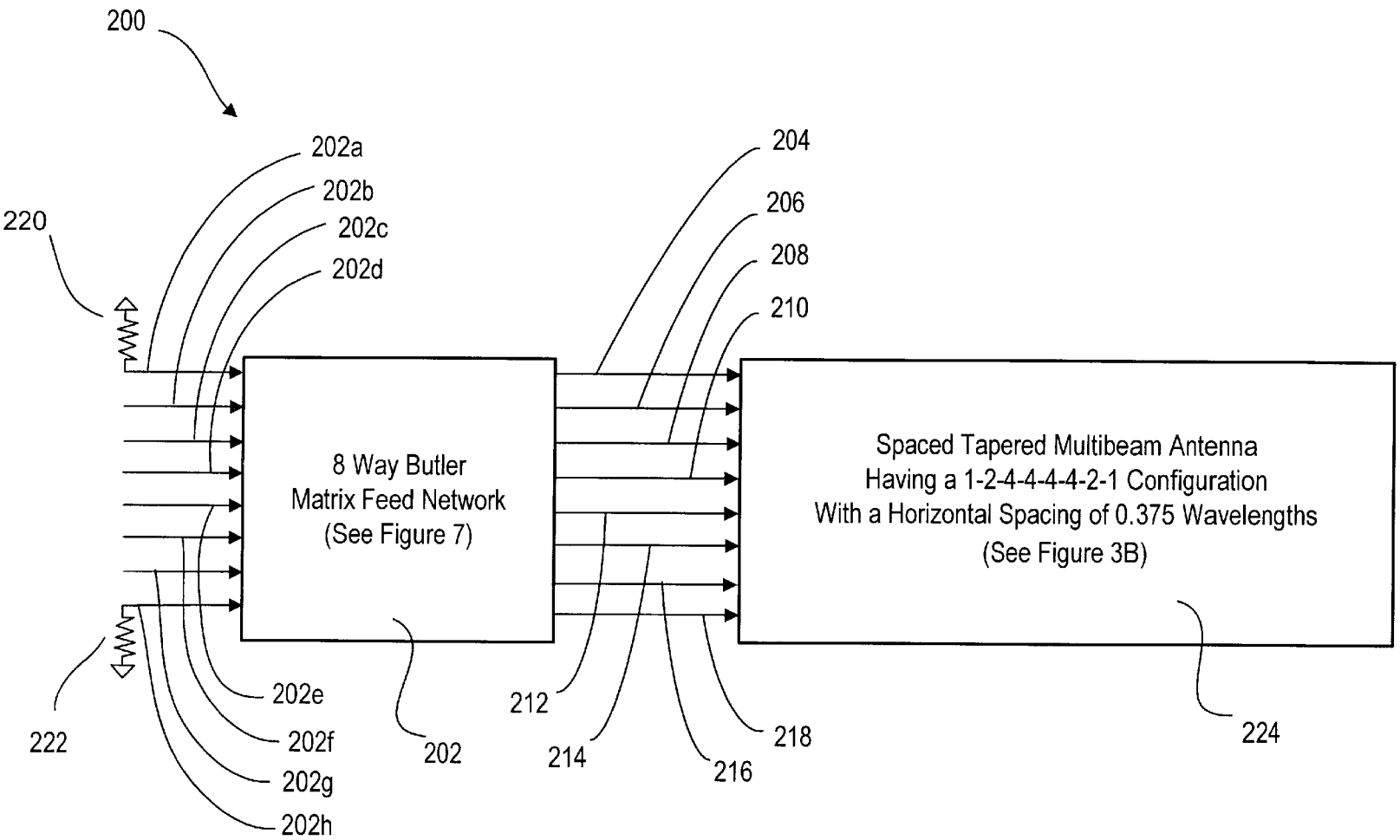
FIG. 3A shows a block diagram of an antenna that is the subject matter of the present invention.

FIG. 3A shows a one hundred and twenty degree antenna generally indicated as 200 having an 8-way Butler matrix feed network 202, having a space tapered multibeam antenna 224 with a 1-2-4-4-4-4-2-1 configuration and a horizontal spacing of 0.375 λ, and also having eight cables 204, 206, 208, 210, 212, 214, 216, 218 with the same cable lengths for connecting the 8-way Butler matrix feed network 202 to the space tapered multibeam antenna 224. The one hundred and twenty degree antenna 200 provides six twenty degree beams.

In effect, the one hundred and twenty degree antenna 200 works with the principles used on the original four beam antenna shown and described with respect to FIG. 1A. However, instead of four rows of dipoles there are eight rows. When hooked up to the 8-way Butler matrix feed network 202, eight fifteen degree beams are normally formed.

For the present invention the eight rows are squeezed into the space normally occupied by six rows for providing the six twenty degree beams. This gives the antenna a horizontal spacing of 0.375 wavelengths.

In operation, the one hundred and twenty degree antenna 200 is a six beam antenna that is a compromise between the four and eight beam models. It has the same side-lobe suppression as the four beam antenna with a fifty percent increase in channel capacity. This is not as large an increase as the eight beam antenna, but the side-lobe suppression is much better. (A normal antenna with half wavelength spacing between the dipoles would have eight usable beams. Due to the compressed spacing, only six beams are usable.)

Figure 7:
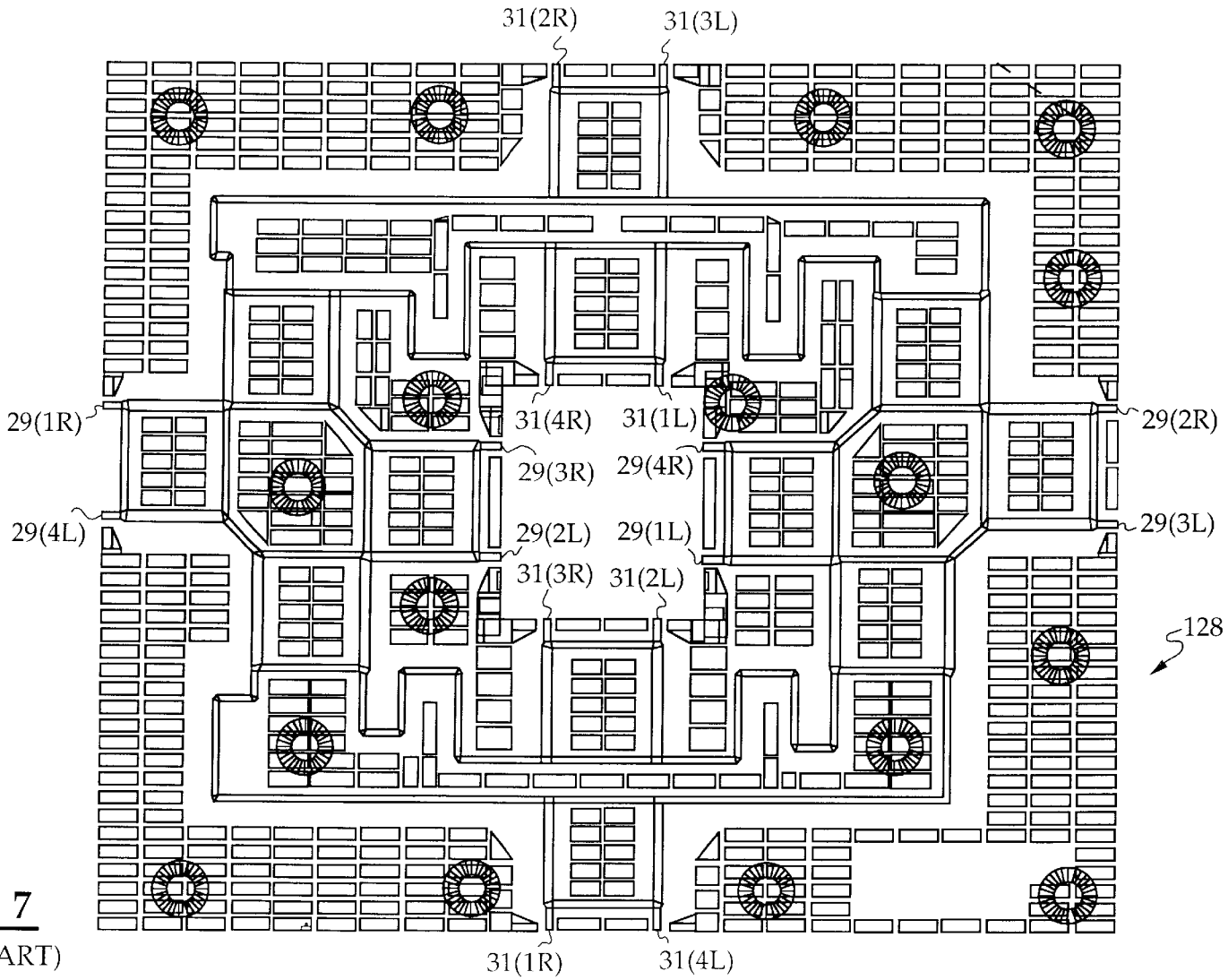
FIG. 7 (PRIOR ART)
FIG. 7 shows an 8-way Butler matrix feed network 128 that is part of the antenna 200 shown in FIG. 3A.

The 8-way Butler matrix feed network 202 is known in the art, is shown and described with respect to FIG. 7 of U.S. Pat. No. 5,589,843, and is connected to a radio receiver and/or transmitter (not shown) such as 37 shown in FIG. 1A. As shown, the 8-way Butler matrix feed network 202 has eight input ports 202*a*, 202*b*, 202*c*, 202*d*, 202*e*, 202*f*, 202*g*, 202*h*. Only six of the eight input ports 202*b*, 202*c*, 202*d*, 202*e*, 202*f*, 202*g* receive antenna input signals from the radio receiver and/or transmitter (not shown). The other two input ports 202*a*, 202*h* are connected via a respective resistor 220, 222 to electrical ground. In one embodiment, the respective resistors 220, 222 are 50 ohm resistors, although the scope of the invention is not intended to be limited to any particular resistor value.

As shown, the eight cables 204, 206, 208, 210, 212, 214, 216, 218 provide eight Butler matrix feed network signals to the space tapered multibeam antenna 224.

Figure 3B:
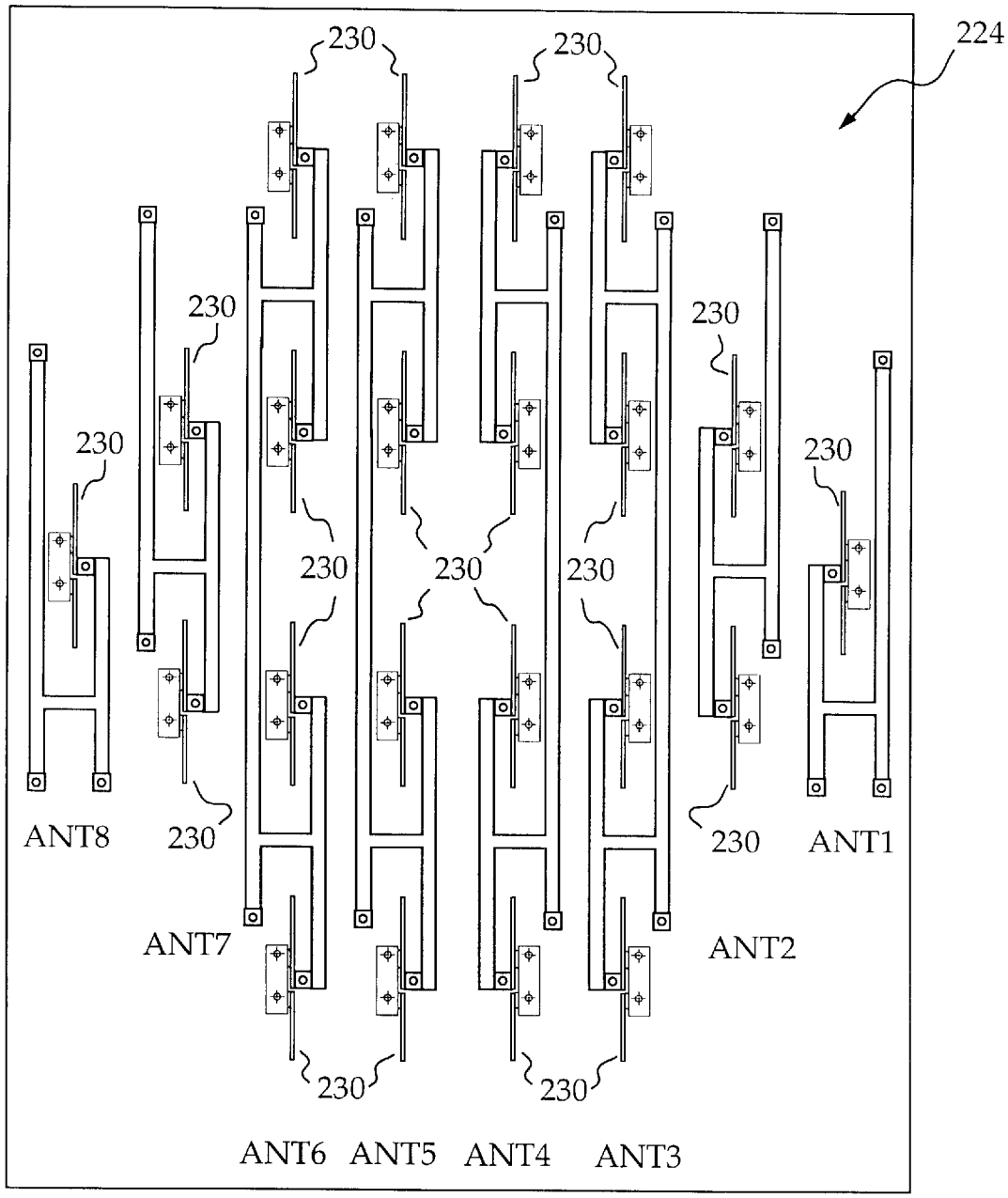
FIG. 3B shows a diagram of an space tapered multibeam antenna that is part of the antenna shown in FIG. 3A.

FIG. 3B generally shows the space tapered multibeam antenna 224 having the 1-2-4-4-4-4-2-1 configuration and the horizontal spacing of 0.375 λ. The space-tapered multibeam antenna 224 includes eight co-linear antenna arrays ANT1, ANT2, ANT3, ANT4, ANT5, ANT6, ANT7, ANT8 of associated electromagnetic radiating elements 230. Similar to that shown and described in FIGS. 1A and 2A, these radiating elements 230 are typically dipole elements, although other types of radiating element can be used. Each of the eight Butler matrix feed network signals on the eight cables 204, 206, 208, 210, 212, 214, 216, 218 is separately provided to a respective antenna ANT1, ANT2, ANT3, ANT4, ANT5, ANT6, ANT7, ANT8 of the space-tapered multibeam antenna 224 by cables and connectors (not shown) associated with each antenna array, which a person skilled in the art would appreciate how to do. For the embodiment in FIGS. 3A and 3B, the cables (not shown) are all the same length (i.e. equal phase cables) so as not to introduce any phase change with respect to the signals carried thereover relative to the other cables. Similar to that shown and described in FIGS. 1A and 2A, the space tapered multibeam antenna 224 uses a feedstrap configuration that is known in the art as the Bogner type feed.

The one hundred and twenty degree antenna 200 provides six twenty degree beams at the following angles:

| BEAM | ANT1 | ANT2 | ANT3 | ANT4 | ANT5 | ANT6 | ANT7 | ANT8 |
|---|---|---|---|---|---|---|---|---|
| 3R | 0 | −112.5 | +135 | +22.5 | −90 | +157.5 | +45 | −67.5 |
| 2L | 0 | −67.5 | −135 | +157.5 | +90 | +22.5 | −45 | −112.5 |
| 1L | 0 | −22.5 | −45 | −67.5 | −90 | −112.5 | −135 | −157.5 |
| 1R | 0 | +22.5 | +45 | +67.5 | +90 | +112.5 | +135 | +157.5 |
| 2R | 0 | +67.5 | +135 | −157.5 | −90 | −22.5 | +45 | +112.5 |
| 3R | 0 | +112.5 | −135 | −22.5 | +90 | −157.5 | −45 | +67.5 |

Figure 3C:
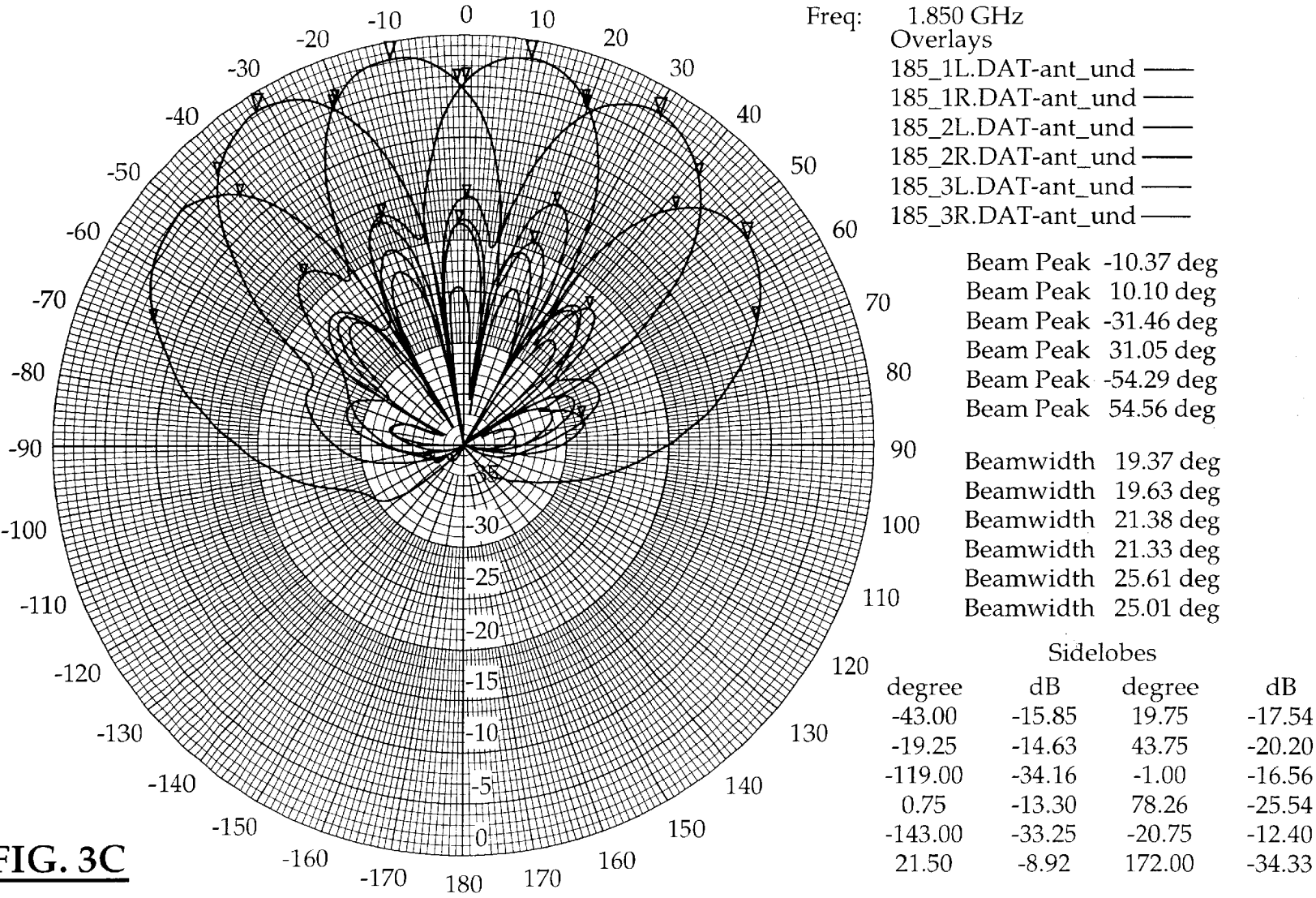
FIGS. 3C, 3D, 3E show frequency plots for the antenna in FIG. 3A respectively at frequencies of 1.850 GHz, 1.920 GHz and 1.990 GHZ.
Figure 3D:
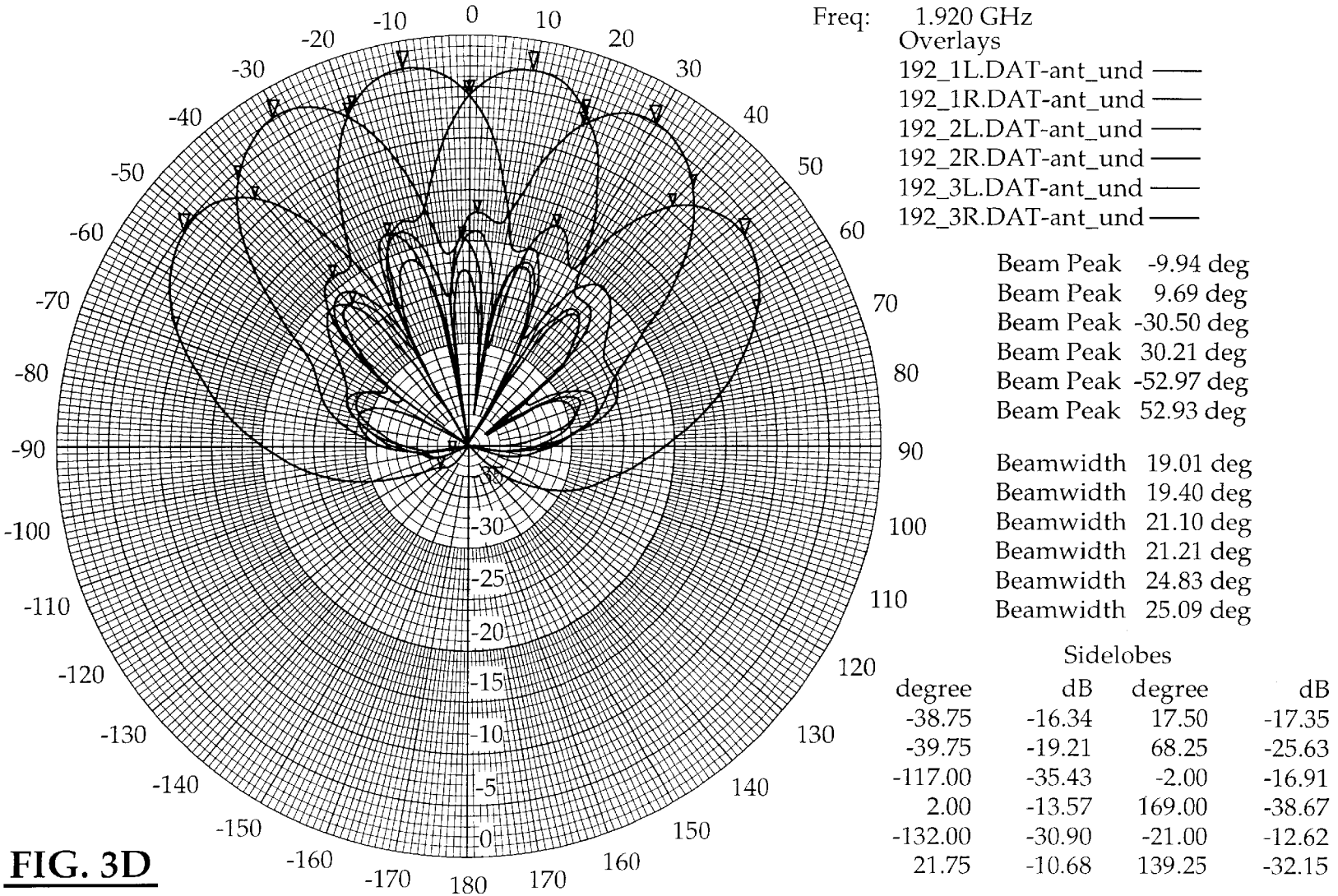
Figure 3E:
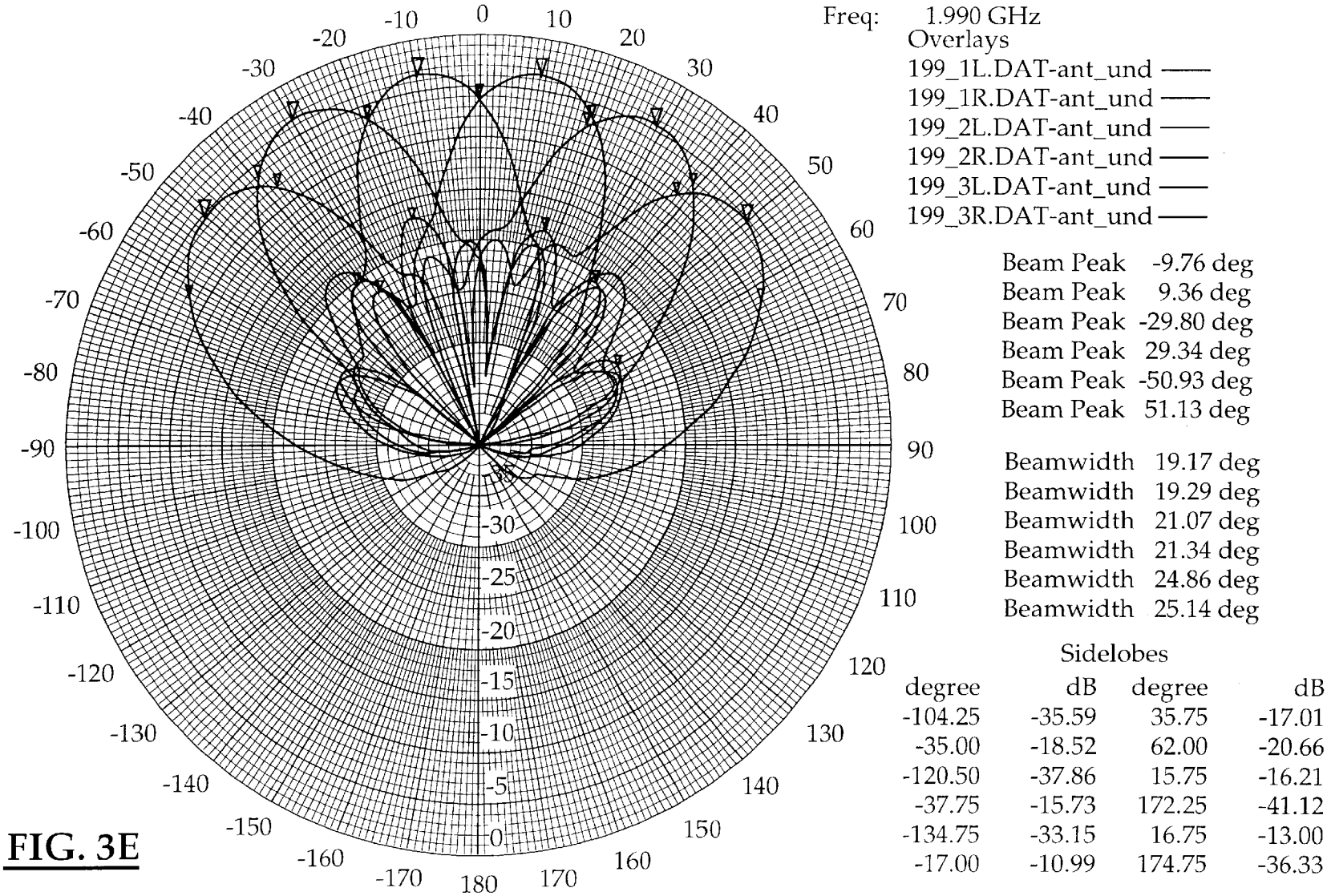

FIGS. 3C, 3D, 3E show frequency plots for the antenna in FIG. 3A respectively at frequencies of 1.850 GHz, 1.920 GHz and 1.990 GHZ. As a person skilled in the antenna design art would appreciate, each plot shows various plot characteristics, including four plot overlays (i.e. 1L, 1R, 2L, 2R, 3L, 3R), six beam peaks in degrees, six beamwidths in degrees, six f/b ratios in dB and six sidelobes in degrees and dBs. In FIGS. 3C, 3D, 3E the various "triangles" help to indicate these various plot characteristics.

In order to achieve desired side-lobe suppression, a space taper technique is used. The eight rows of dipoles do not have an equal number of elements. The 1-2-4-4-4-4-2-1 configuration supplies a side-lobe suppression of −9 dB. Fine tuning the antenna may eventually get the side-lobe suppression of −10 dB.

In comparison to the present invention, the known prior art space tapered one hundred twenty degree antenna has four thirty degree beams or eight fifteen degree beams. The four beam antennas do not provide as much channel capacity as the eight beam models. The eight beam models suffer from even higher side-lobe levels than the four beam antennas.

The one hundred and twenty degree antenna 200 of the present invention can be used wherever the original four beam antenna is used.

Figure 4A:
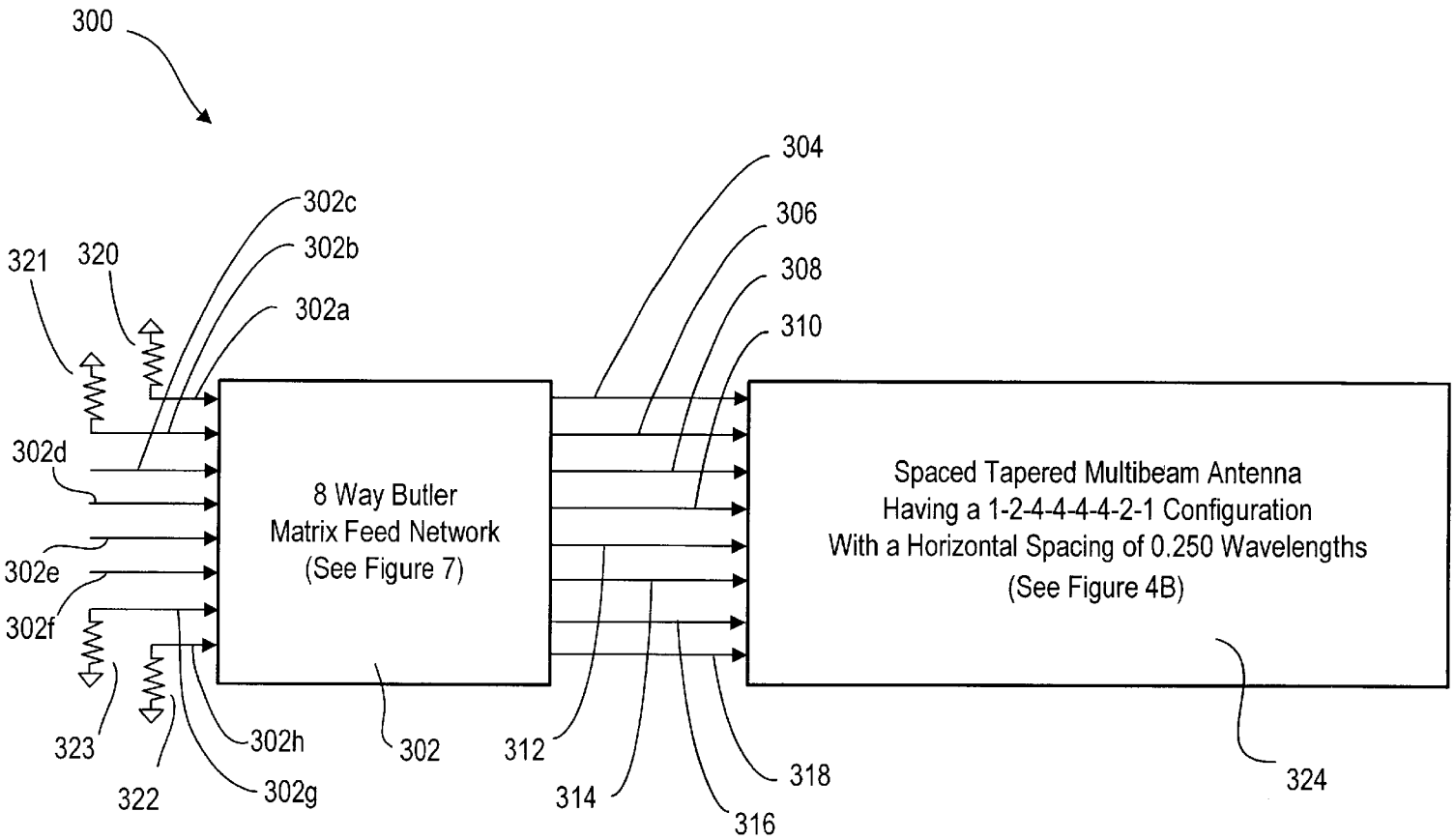
FIG. 4A shows a block diagram of an antenna that is the subject matter of the present invention.

Space Tapered 120° Multibeam Antenna With Four 30° Beams and Suppressed Side-lobes FIG. 4A shows a one hundred and twenty degree antenna generally indicated as 300 having an 8-way Butler matrix feed network 302, having a space tapered multibeam antenna 324 with a 1-2-4-4-4-4-2-1 configuration and a horizontal spacing of 0.250 λ, and also having eight cables 304, 306, 308, 310, 312, 314, 316, 318 with the same cable lengths for connecting the 8-way Butler matrix feed network 302 to the space tapered multibeam antenna 324. The one hundred and twenty degree antenna 300 provides four thirty degree beams.

In effect, the one hundred and twenty degree antenna 300 works with the principles used on the original four beam antenna shown and described with respect to FIG. 1A. However, instead of four rows of dipoles, there are eight rows. When hooked up to a typical 8-way Butler matrix feed network, eight fifteen degree beams are normally formed. However, in the present invention the eight rows may be squeezed into the space normally occupied by four rows for providing four thirty degree beams. This gives the one hundred and twenty degree antenna 300 a horizontal spacing of 0.250 wavelengths.

The 8-way Butler matrix feed network 302 is known in the art, is shown and described with respect to FIG. 7 of U.S. Pat. No. 5,589,843, and is connected to a radio receiver and/or transmitter (not shown) such as 37 shown in FIG. 1A. As shown, the 8-way Butler matrix feed network 302 has eight input ports 302*a*, 302*b*, 302*c*, 302*d*, 302*e*, 302*f*, 302*g*, 302*h*. Only four of the eight input ports 302*c*, 302*d*, 302*e*, 302*f* receive antenna input signals from the radio receiver and/or transmitter (not shown). The other four input ports 302*a*, 302*b*, 302*g*, 302*h* are connected via a respective resistor 320, 321, 322, 323 to electrical ground. In one embodiment, the respective resistor 320, 321, 322, 323 are 50 ohm resistors, although the scope of the invention is not intended to be limited to any particular resistor value.

As shown, the eight cables 304, 306, 308, 310, 312, 314, 316, 318 provide eight Butler matrix feed network signals to the space tapered multibeam antenna 324.

Figure 4B:
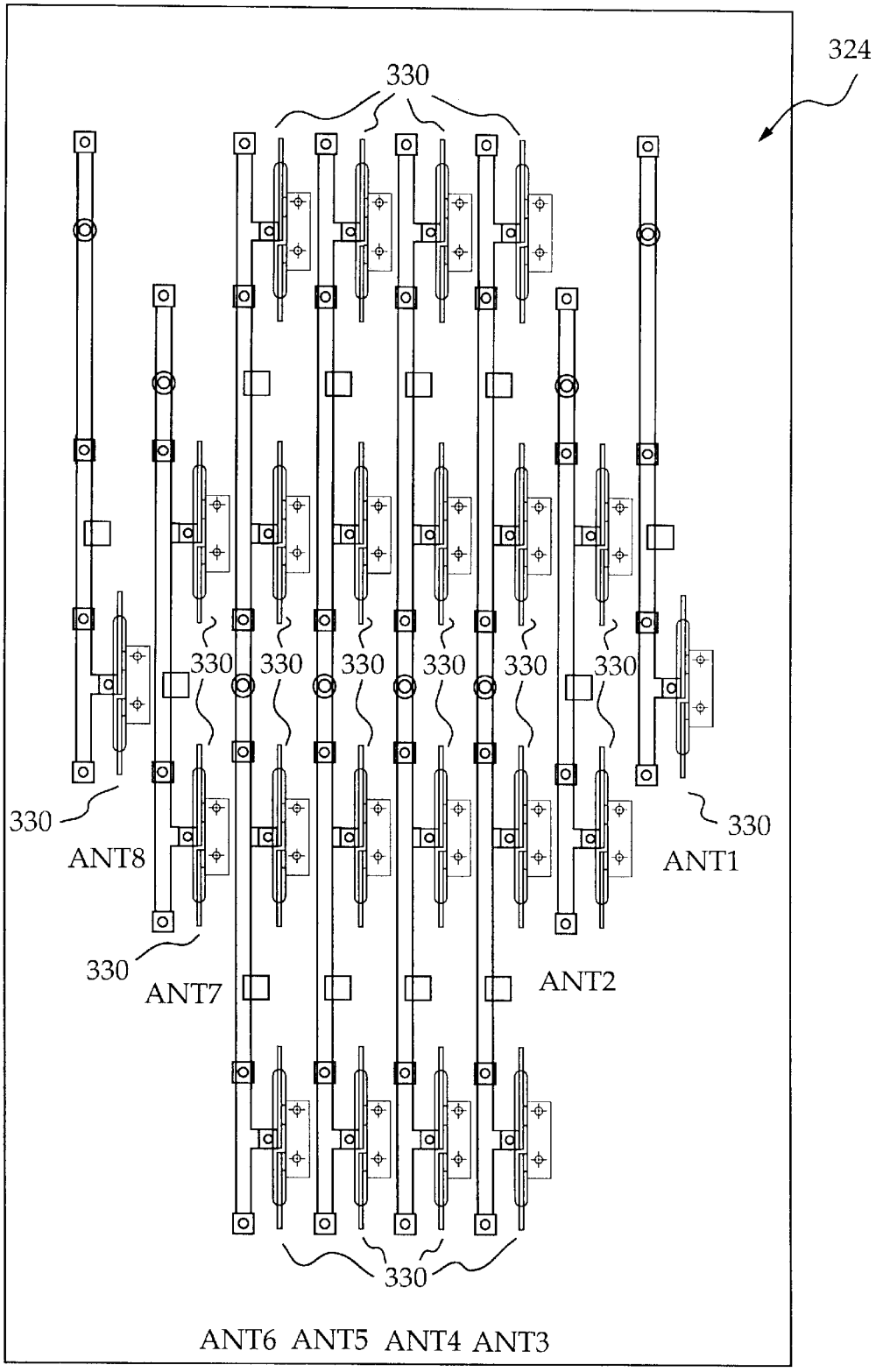
FIG. 4B shows a diagram of an space tapered multibeam antenna that is part of the antenna shown in FIG. 4A.

FIG. 4B generally shows the space tapered multibeam antenna 324 having the 1-2-4-4-4-4-2-1 configuration and the horizontal spacing of 0.250 λ. The space-tapered multibeam antenna 324 includes eight co-linear antenna arrays ANT1, ANT2, ANT3, ANT4, ANT5, ANT6, ANT7, ANT8 of associated electromagnetic radiating elements 330. Similar to that shown and described in FIGS. 1A, 2A, 3A, these radiating elements 330 are typically dipole elements, although other types of radiating element can be used. Each of the eight Butler matrix feed network signals on the eight cables 304, 306, 308, 310, 312, 314, 316, 318 is separately provided to a respective antenna ANT1, ANT2, ANT3, ANT4, ANT5, ANT6, ANT7, ANT8 of the space tapered multibeam antenna 324 by cables and connectors (not shown) associated with each antenna array, which a person skilled in the art would appreciate how to do. For the embodiment in FIGS. 4A and 4B, the cables (not shown) are all the same length (i.e. equal phase cables) so as not to introduce any phase change with respect to the signals carried thereover relative to the other cables. Similar to that shown and described in FIGS. 1A, 2A, 3A, the space tapered multibeam antenna 324 uses a feedstrap configuration that is known in the art as the Bogner type feed.

In order to achieve further side-lobe suppression, a space taper technique is used. The eight rows of dipoles do not have an equal number of elements. The 1-2-4-4-4-4-2-1 configuration supplies a side-lobe suppression of −15 dB. This antenna is also much broader banded than the original four beam model. It has a working bandwidth of 280 MHz as opposed to the normal 140 MHz.

The one hundred and twenty degree antenna 300 provides four thirty degree beams at the following angles:

| | ANT1 | ANT2 | ANT3 | ANT4 | ANT5 | ANT6 | ANT7 | ANT8 |
|---|---|---|---|---|---|---|---|---|
| BEAM 2L | 0 | −67.5 | −135 | +157.5 | +90 | +22.5 | −45 | −112.5 |
| BEAM 1L | 0 | −22.5 | −45 | −67.5 | −90 | −112.5 | −135 | −167.5 |
| BEAM 1R | 0 | +22.5 | +45 | +67.5 | +90 | +112.5 | +135 | +167.5 |
| BEAM 2R | 0 | +67.5 | +135 | −157.5 | −90 | −22.5 | +45 | +112.5 |

Figure 4C:
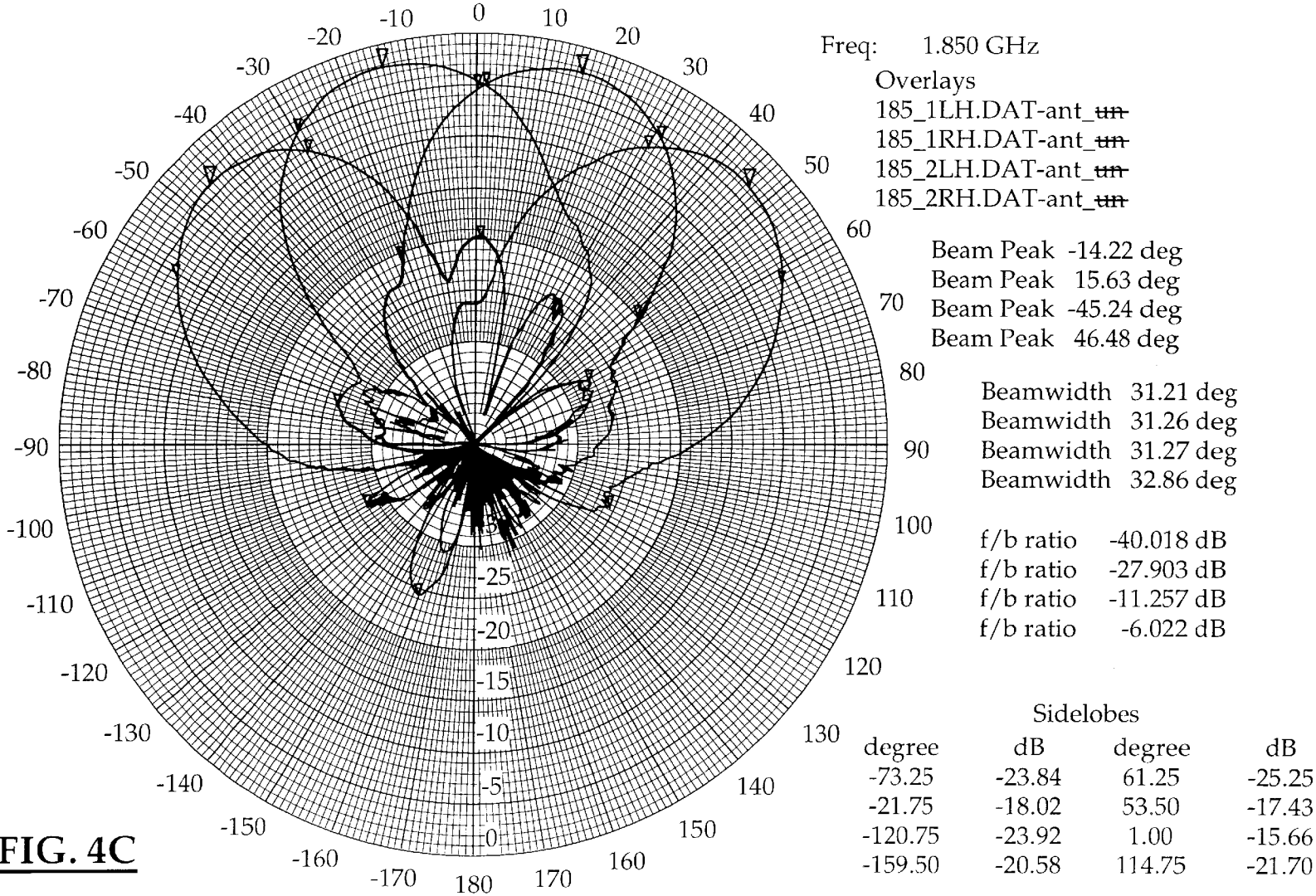
FIGS. 4C, 4D, 4E show frequency plots for the antenna in FIG. 4A respectively at frequencies of 1.850 GHz, 1.920 GHz and 1.990 GHZ.
Figure 4D:
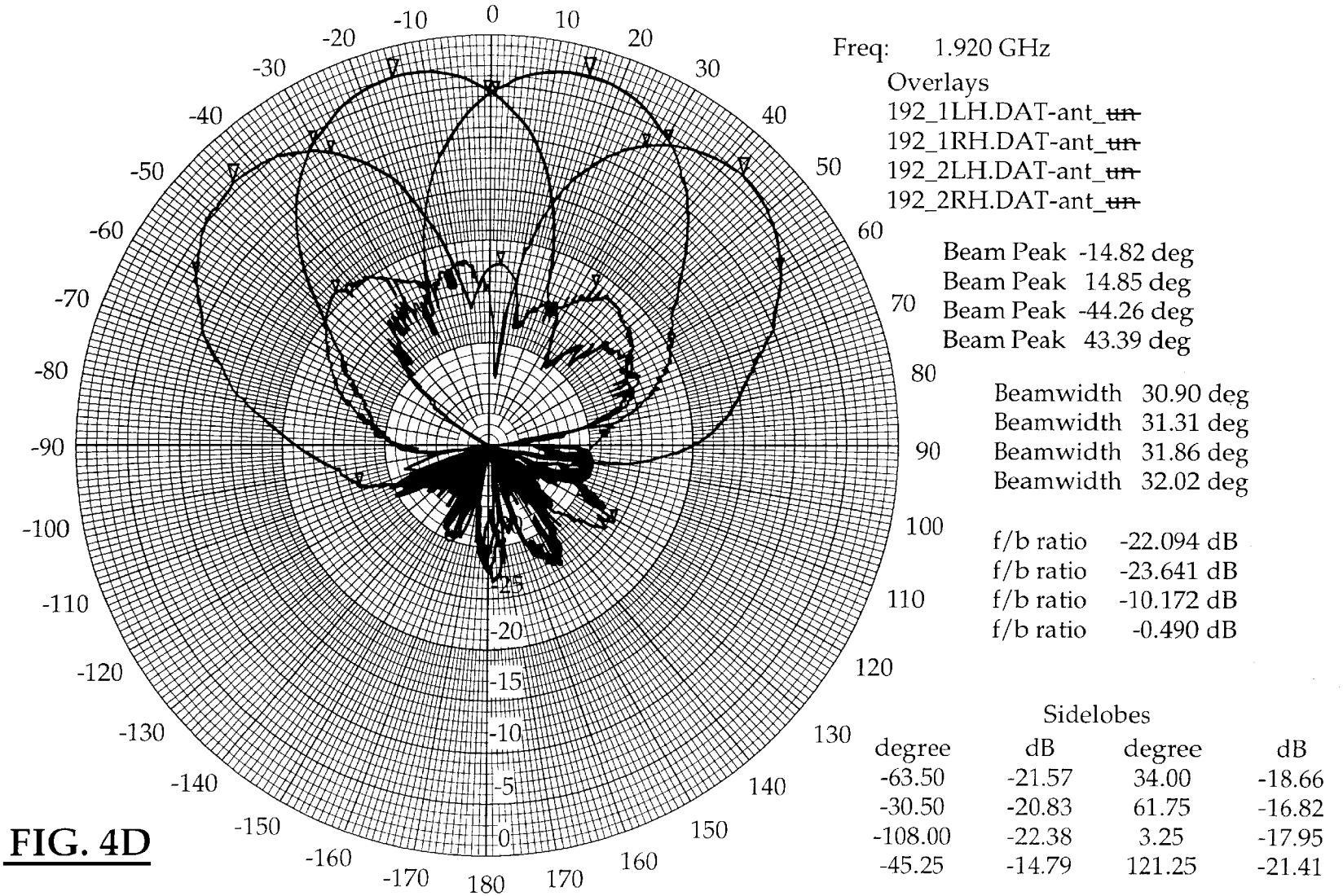
Figure 4E:
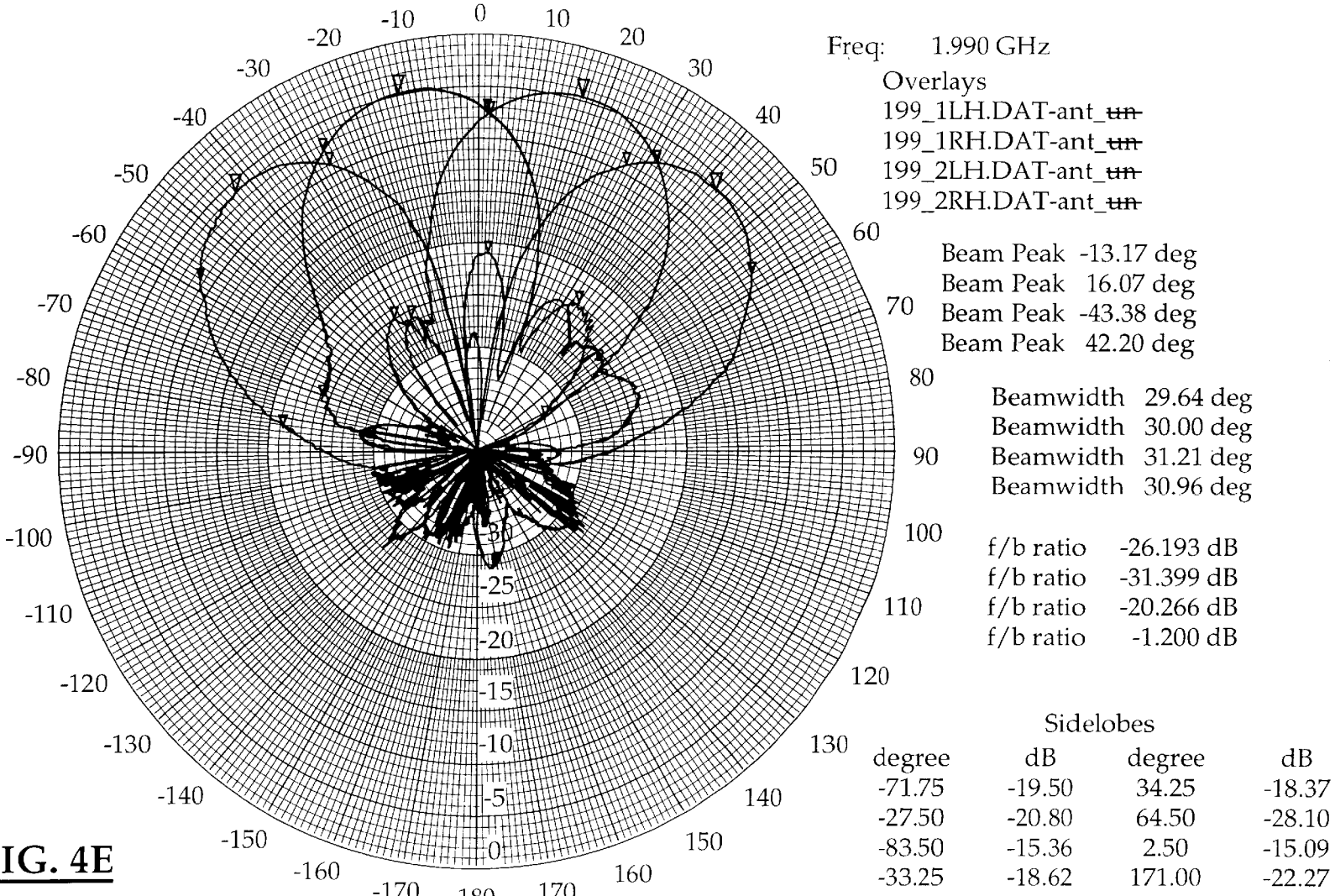

FIGS. 4C, 4D, 4E show frequency plots for the antenna in FIG. 4A respectively at frequencies of 1.850 GHz, 1.920 GHz and 1.990 GHZ. As a person skilled in the antenna design art would appreciate, each plots shows various plot characteristics, including four plot overlays (i.e. 1L, 1R, 2L, 2R), four beam peaks in degrees, four beamwidths in degrees, four f/b ratios in dB and four sidelobes in degrees and dBs. In FIGS. 4C, 4D, 4E, the various "triangles" help to indicate these various plot characteristics.

The suppressed side-lobe one hundred twenty degree antenna has side-lobe suppression better than −15 dB. The outer beams do not have the gain drop off associated with the one hundred twenty degree antenna as shown in the frequency plots in FIGS. 4C, 4D, 4E.

In comparison to the present invention, a normal antenna with half wavelength spacing between the dipoles would have eight usable beams. In the present invention, due to the compressed spacing, only four beams are usable. Also, half of the feedlines are on the back side of the reflector. This means the feedlines on the front side of the reflector are two half wavelengths long. For proper side-lobe suppression, an antenna needs to have feedlines which are an even number of half wavelengths long.

The prior art space tapered one hundred twenty degree antennas have four thirty degree beams. These one hundred twenty degree antennas suffer from high side-lobe levels that do not meet customer specifications of being below −10 dB from the beam peak. Also, the outer beams suffer from a drop in gain as compared to the inner beams. See the frequency plots in FIGS. 1C, 1D, 1E.

The antenna 300 can be used wherever the original four beam antenna is used.

Space Tapered 60° Multibeam Antenna with Three 20° Beams

Figure 5A:
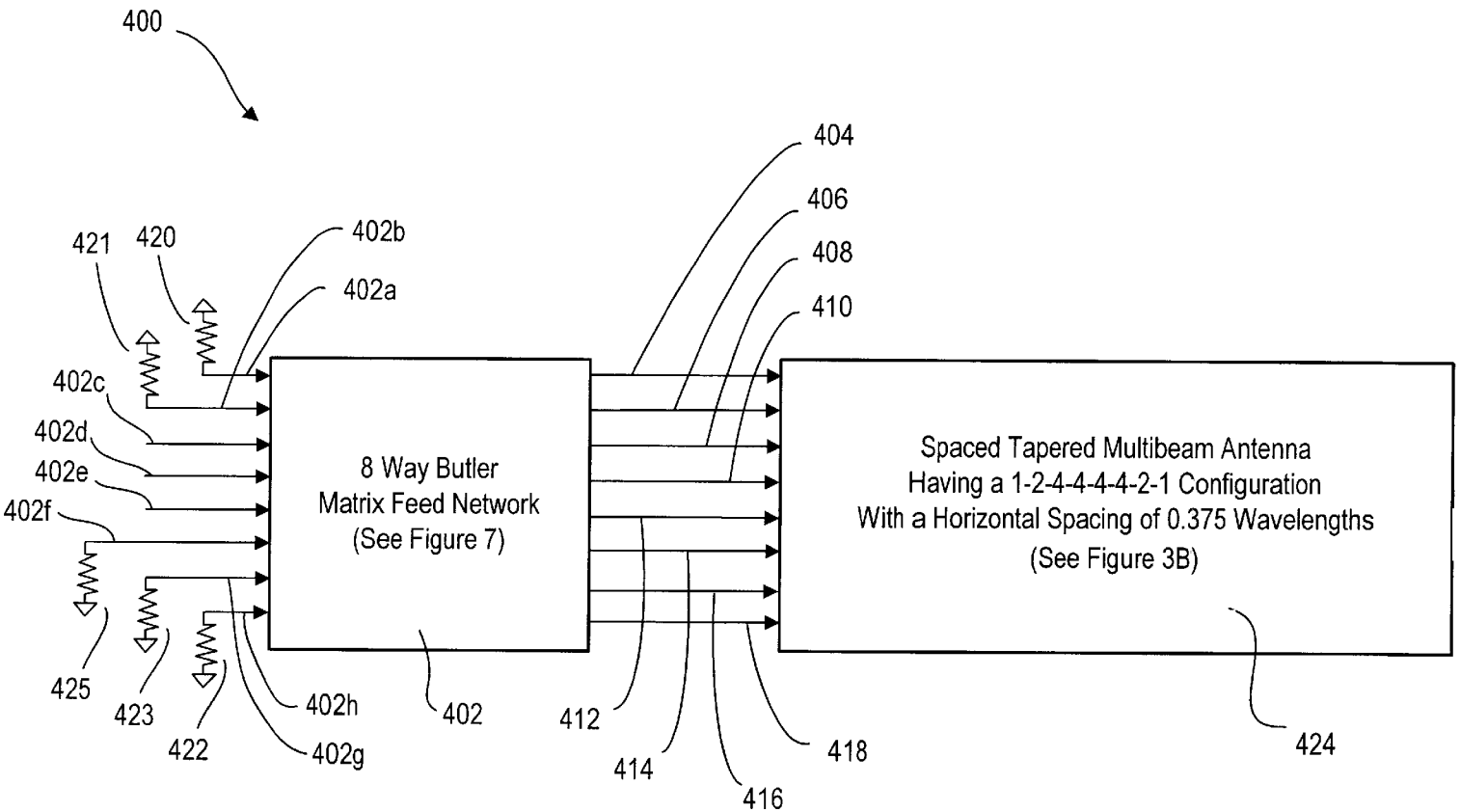
FIG. 5A shows a block diagram of an antenna that is the subject matter of the present invention.

FIG. 5A shows a sixty degree antenna generally indicated as 400 having an 8-way Butler matrix feed network 402, having a space tapered multibeam antenna 424 with a 1-2-4-4-4-4-2-1 configuration and a horizontal spacing of 0.375 λ, and also having eight cables 404, 406, 408, 410, 412, 414, 416, 418 with the different cable lengths for connecting the 8-way Butler matrix feed network 402 to the space tapered multibeam antenna 424 to provide twenty two and a half degree phase progression. The sixty degree antenna 400 provides three twenty degree beams.

In effect, the antenna works with the principles used on the original four beam antenna. Instead of four rows of dipoles there are eight rows. When hooked up to an eight way Butler matrix, eight fifteen degree beams are normally formed. In the present invention, the eight rows were squeezed into the space normally occupied by six rows for providing the three twenty degree beams. This gives the antenna a horizontal spacing of 0.375 wavelengths.

The 8-way Butler matrix feed network 402 is known in the art, shown and described with respect to FIG. 7 of U.S. Pat. No. 5,589,843, and is connected to a radio receiver and/or transmitter (not shown) such as 37 shown in FIG. 1A. As shown, the 8-way Butler matrix feed network 402 has eight input ports 402*a*, 402*b*, 402*c*, 402*d*, 402*e*, 402*f*, 402*g*, 402*h*. Only three of the eight input ports 402*c*, 402*d*, 402*e* receive antenna input signals from the radio receiver and/or transmitter (not shown). The other five input ports 402*a*, 402*b*, 402*f*, 402*g*, 402*h* are connected via a respective resistor 420, 421, 422, 423, 425 to electrical ground. In one embodiment, the respective resistors 420, 421, 422, 423, 425 are 50 ohm resistors, although the scope of the invention is not intended to be limited to any particular resistor value.

The phase progression of the 8-way Butler matrix feed network 402 is as follows:

| BEAM | ANT1 | ANT2 | ANT3 | ANT4 | ANT5 | ANT6 | ANT7 | ANT8 |
|---|---|---|---|---|---|---|---|---|
| 3R | 0 | −112.5 | +135 | +22.5 | −90 | +157.5 | +45 | −67.5 |
| 2L | 0 | −67.5 | −135 | +157.5 | +90 | +22.5 | −45 | −112.5 |
| 1L | 0 | −22.5 | −45 | −67.5 | −90 | −112.5 | −135 | −157.5 |
| 1R | 0 | +22.5 | +45 | +67.5 | +90 | +112.5 | +135 | +157.5 |
| 2R | 0 | +67.5 | +135 | −157.5 | −90 | −22.5 | +45 | +112.5 |
| 3R | 0 | +112.5 | −135 | −22.5 | +90 | −157.5 | −45 | +67.5 |

As shown, the eight cables 404, 406, 408, 410, 412, 414, 416, 418 provide eight Butler matrix feed network signals to the space tapered multibeam antenna 424.

The space tapered multibeam antenna 424 is shown in FIG. 3B generally having the 1-2-4-4-4-4-2-1 configuration and the horizontal spacing of 0.375 λ. In order to achieve further side-lobe suppression a space taper technique was used. The eight rows of dipoles do not have an equal number of elements. The 1-2-4-4-4-4-2-1 configuration supplies a side-lobe suppression of −14 dB.

When the cables 404, 406, 408, 410, 412, 414, 416 418 have a phase progression of 0, +22.5, +45, +67.5, +90, +112.5, +135, +157.5 together with the standard phase progression of the Butler matrix, then sixty degree antenna generally indicated as 400 provides three twenty degree beams at the following angles:

| BEAM | ANT1 | ANT2 | ANT3 | ANT4 | ANT5 | ANT6 | ANT7 | ANT8 |
|---|---|---|---|---|---|---|---|---|
| 1L | 0 | −45 | −90 | −135 | −180 | +135 | +90 | +45 |
| C | 0 | 0 | 0 | 0 | 0 | 0 | 0 | 0 |
| 1R | 0 | +45 | +90 | +135 | +180 | −135 | −90 | −45 |

Figure 5B:
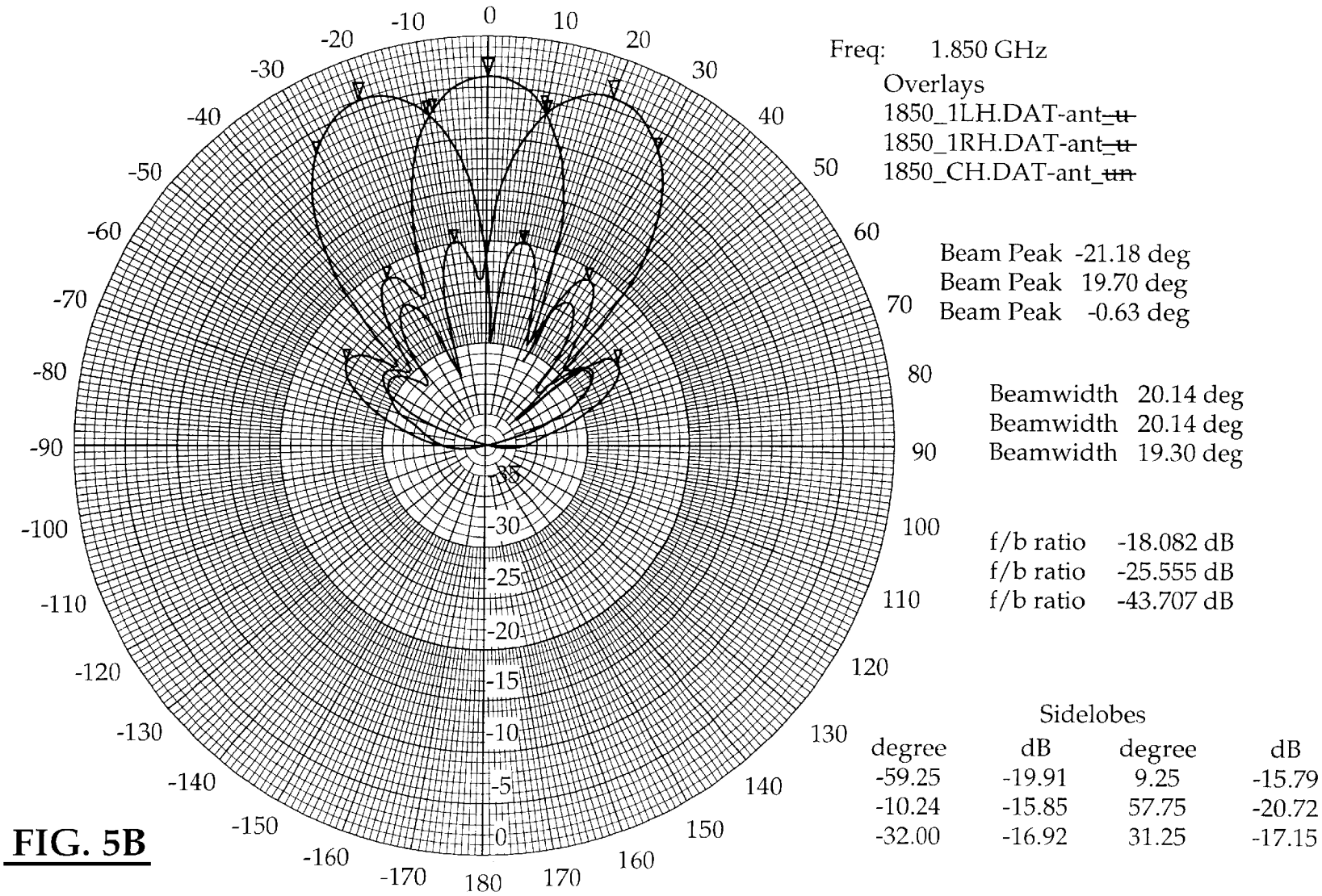
FIGS. 5B, 5C, 5D show frequency plots for the antenna in FIG. 5A respectively at frequencies of 1.850 GHz, 1.920 GHz and 1.990 GHZ.
Figure 5C:
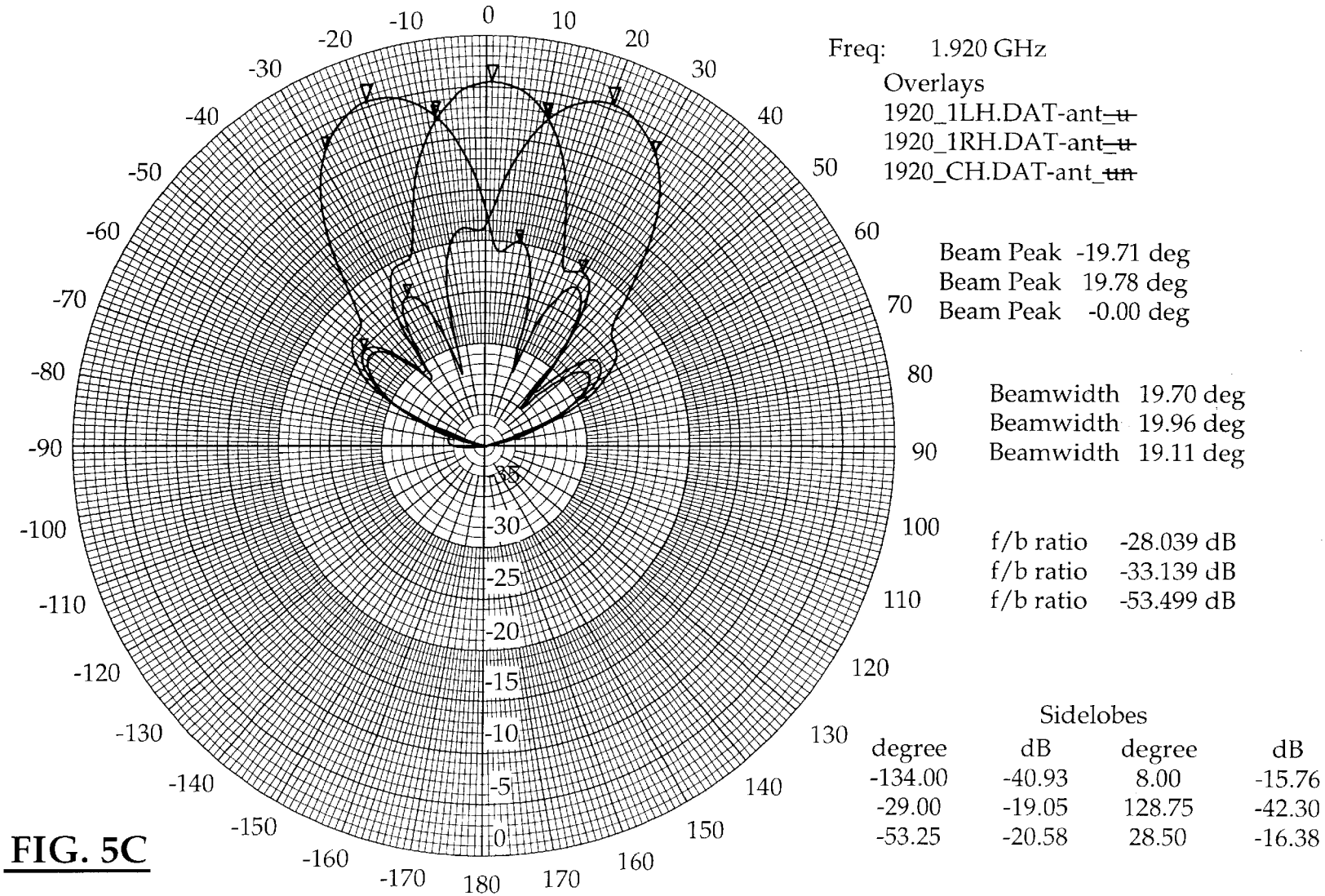
Figure 5D:
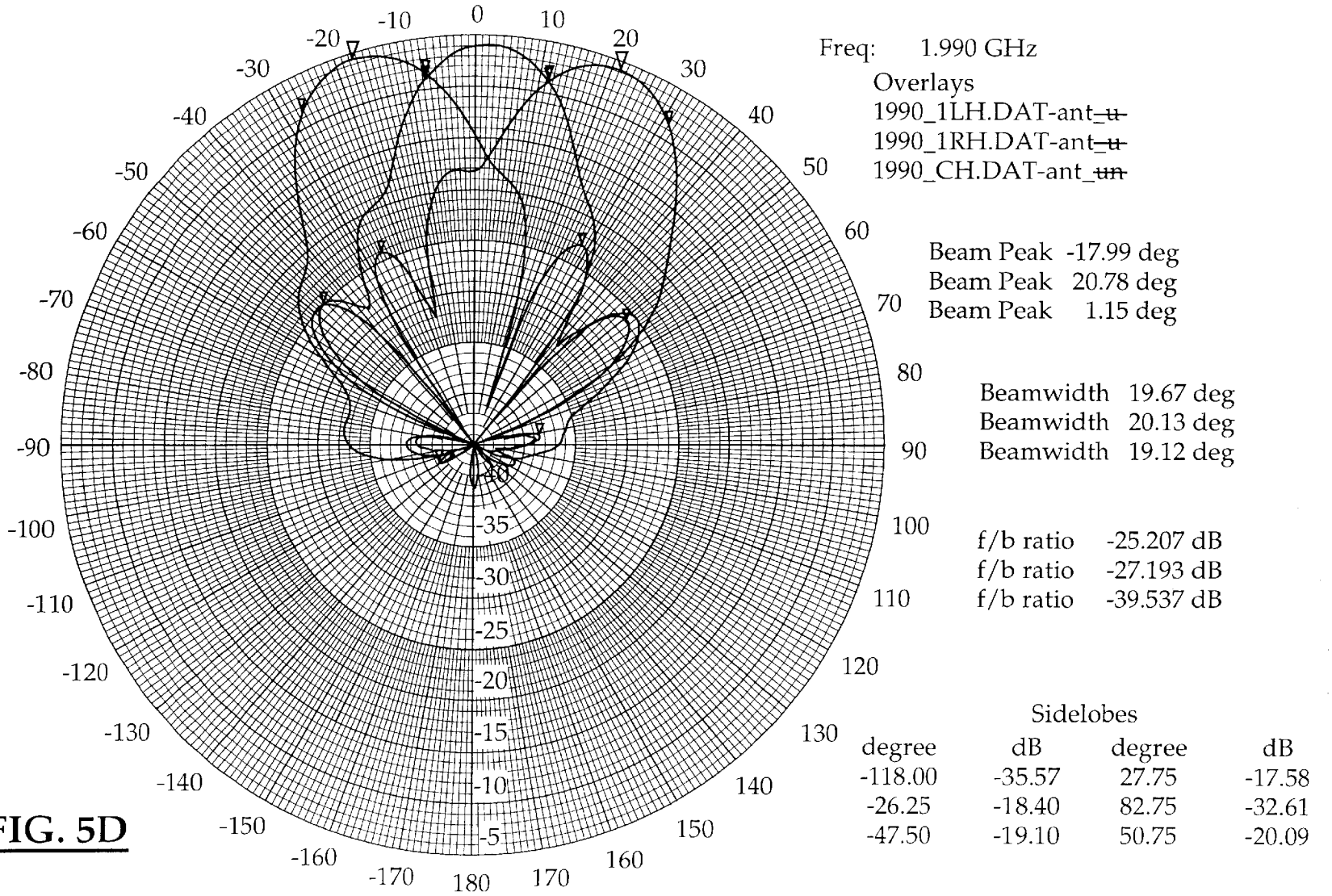

FIGS. 5B, 5C, 5D show frequency plots for the antenna in FIG. 5A respectively at frequencies of 1.850 GHz, 1.920 GHz and 1.990 GHZ. As a person skilled in the antenna design art would appreciate, each plot shows various plot characteristics, including three plot overlays (i.e. 1L, 1R, CH), three beam peaks in degrees, three beamwidths in degrees, three f/b ratios in dB and four sidelobes in degrees and dBs. In FIGS. 5B, 5C, 5D, the various "triangles" help to indicate these various plot characteristics.

The sixty degree antenna has side-lobe suppression better than −14 dB. The outer beams do not have the gain drop off associated with the one hundred twenty degree antenna as shown in the frequency plots in FIGS. 5B, 5C, 5D.

The prior art space tapered one hundred twenty degree antennas has four thirty degree beams. The one hundred twenty degree antenna suffers from high side-lobe levels that do not meet the customer specification of being below −10 dB from the beam peak. Also, the outer beams suffer from a drop in gain as compared to the inner beams. See the frequency plots in FIGS. 1C, 1D, 1E.

A normal antenna would only send beams down either side. To get a middle beam, the equally phased cables normally leading from the Butler matrix to the antennas were replaced with cables having a twenty-two and a half degree phase progression. This shifted the beams so that one was down the middle. This set up actually produces five twenty degree beams, but customer demand was for only three. This could also be done by adding the phase progression directly to the Butler's outputs.

The antenna 400 can be used wherever the original four beam antenna is used.

As shown, the eight cables 504, 506, 508, 510, 512, 514, 516, 518 provide eight Butler matrix feed network signals to the space tapered multibeam antenna 524.

The space tapered multibeam antenna 524 is shown in FIG. 3B generally having the 1-2-4-4-4-4-2-1 configuration and the horizontal spacing of 0.375 λ. In order to achieve further side-lobe suppression a space taper technique was used. The eight rows of dipoles do not have an equal number of elements. The 1-2-4-4-4-4-2-1 configuration supplies a side-lobe suppression of −12 dB.

When the cables 504, 506, 508, 510, 512, 514, 516, 518 have a phase progression of 0, +22.5, +45, +67.5, +90, +112.5, +135, +157.5 together with the standard phase progression of the Butler matrix, then one hundred degree antenna generally indicated as 500 provides five twenty degree beams at the following angles:

| BEAM | ANT1 | ANT2 | ANT3 | ANT4 | ANT5 | ANT6 | ANT7 | ANT8 |
|---|---|---|---|---|---|---|---|---|
| 2L | 0 | −90 | −180 | +90 | 0 | −90 | −180 | +90 |
| 1L | 0 | −45 | −90 | −135 | −180 | +135 | +90 | +45 |
| C | 0 | 0 | 0 | 0 | 0 | 0 | 0 | 0 |
| 1R | 0 | +45 | +90 | +135 | +180 | −135 | −90 | −45 |
| 2R | 0 | +90 | +180 | −90 | 0 | +90 | +180 | −90 |

Figure 5E:
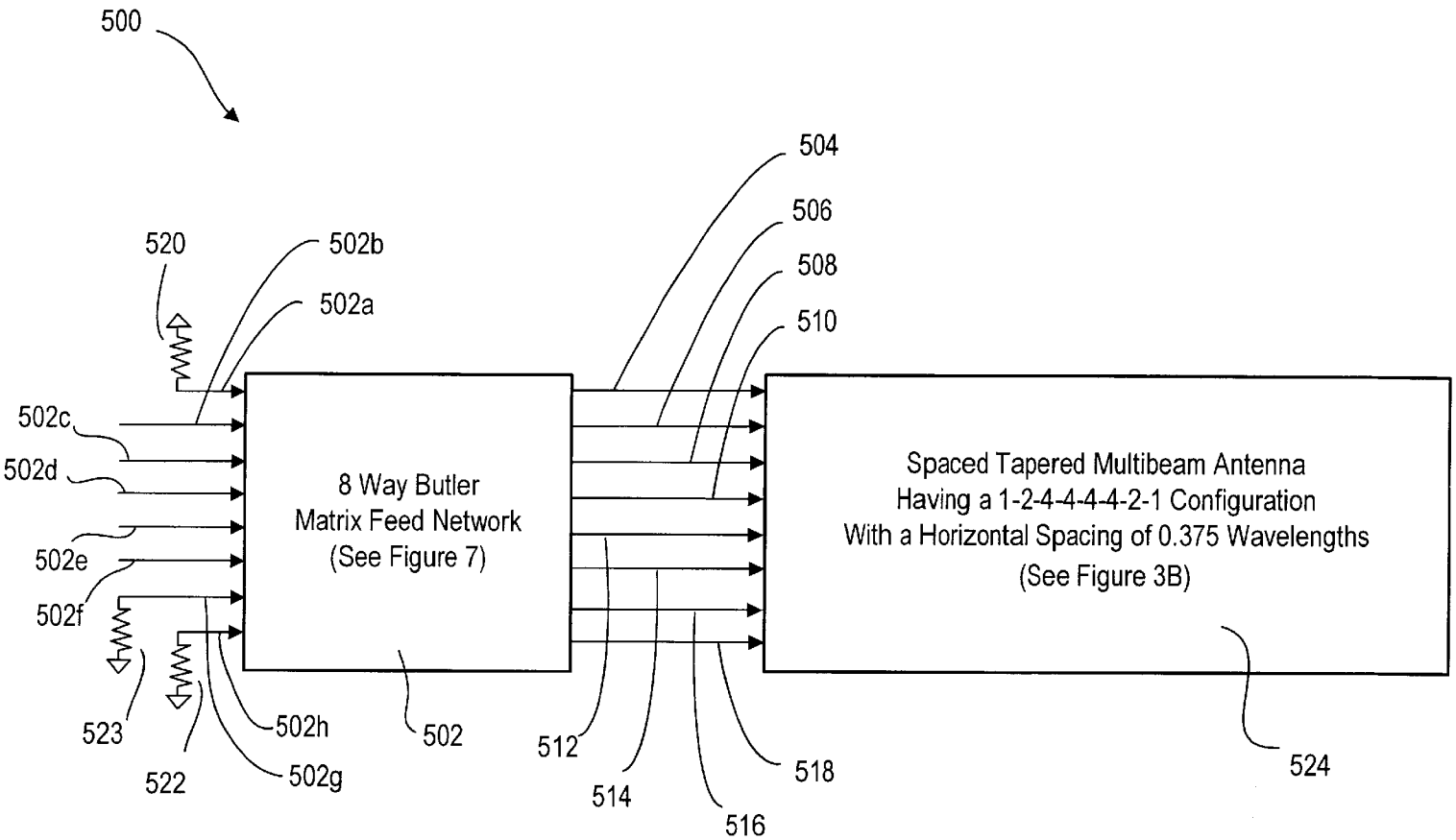
FIG. 5E shows a block diagram of an antenna that is the subject matter of the present invention.

FIG. 5E shows a one hundred degree antenna generally indicated as 500 having an 8-way Butler matrix feed network 502, having a space tapered multibeam antenna 524 with a 1-2-4-4-4-4-2-1 configuration and a horizontal spacing of 0.375 λ, and also having eight cables 504, 506, 508, 510, 512, 514, 516, 518 with the different cable lengths for connecting the 8-way Butler matrix feed network 502 to the space tapered multibeam antenna 524 to provide twenty two and a half degree phase progression. The antenna 500 provides five twenty degree beams.

The 8-way Butler matrix feed network 502 is known in the art, shown and described with respect to FIG. 7 of U.S. Pat. No. 5,589,843, and is connected to a radio receiver and/or transmitter (not shown) such as 37 shown in FIG. 1A. As shown, the 8-way Butler matrix feed network 502 has eight input ports 502*a*, 502*b*, 502*c*, 502*d*, 502*e*, 502*f*, 502*g*, 502*h*. Only five of the eight input ports 502*b*, 502*c*, 502*d*, 502*e*, 502*f* receive antenna input signals from the radio receiver and/or transmitter (not shown). The other three input ports 502*a*, 502*g*, 502*h* are connected via a respective resistor 520, 522, 523 to electrical ground. In one embodiment, the respective resistors 520, 522, 523 are 50 ohm resistors, although the scope of the invention is not intended to be limited to any particular resistor value.

The phase progression of the 8-way Butler matrix feed network 502 is as follows:

| BEAM | ANT1 | ANT2 | ANT3 | ANT4 | ANT5 | ANT6 | ANT7 | ANT8 |
|---|---|---|---|---|---|---|---|---|
| 3R | 0 | −112.5 | +135 | +22.5 | −90 | +157.5 | +45 | −67.5 |
| 2L | 0 | −67.5 | −135 | +157.5 | +90 | +22.5 | −45 | −112.5 |
| 1L | 0 | −22.5 | −45 | −67.5 | −90 | −112.5 | −135 | −157.5 |
| 1R | 0 | +22.5 | +45 | +67.5 | +90 | +112.5 | +135 | +157.5 |
| 2R | 0 | +67.5 | +135 | −157.5 | −90 | −22.5 | +45 | +112.5 |
| 3R | 0 | +112.5 | −135 | −22.5 | +90 | −157.5 | −45 | +67.5 |

Figure 5F:
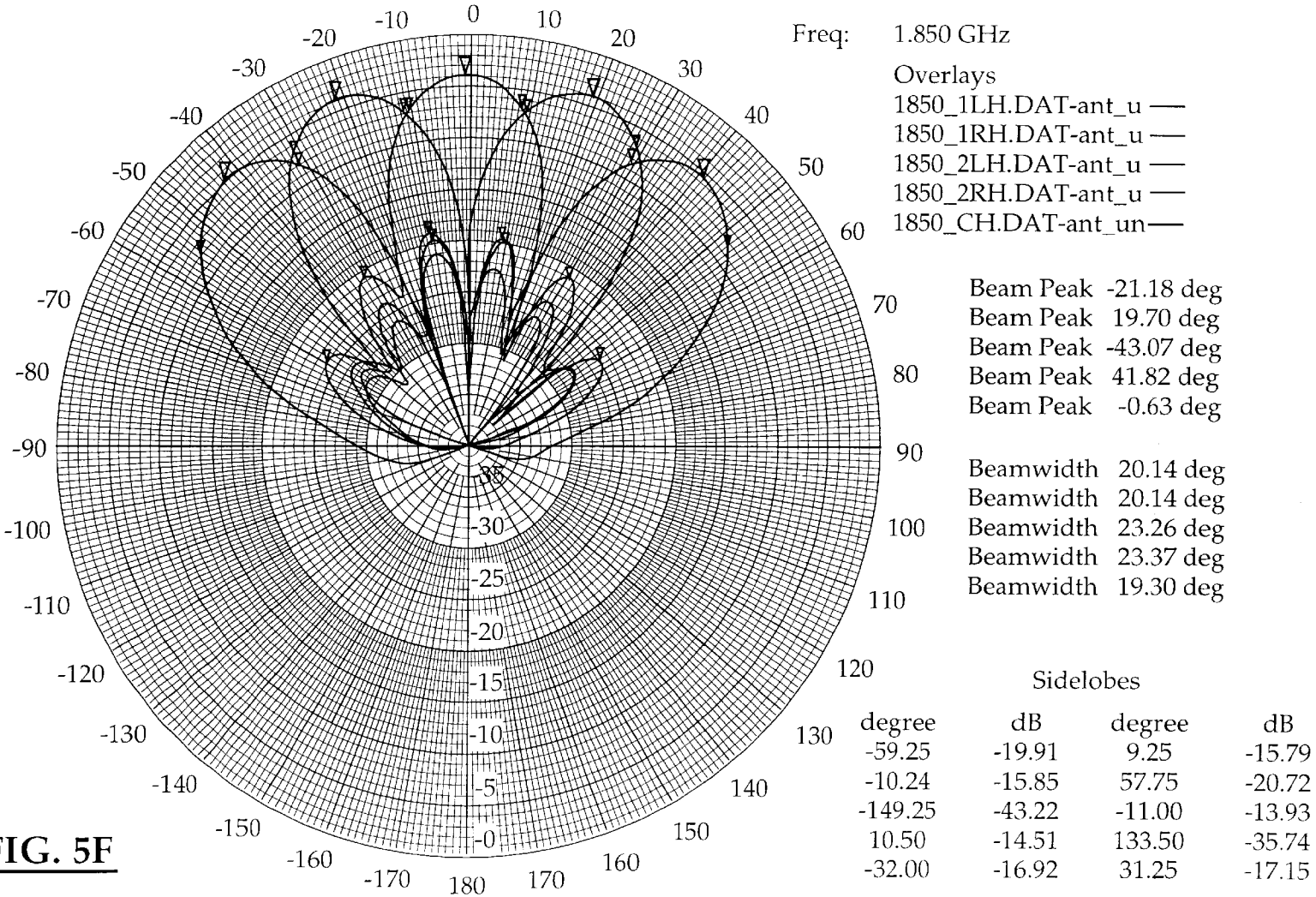
FIGS. 5F, 5G, 5H show frequency plots for the antenna in FIG. 5E respectively at frequencies of 1.850 GHz, 1.920 GHz and 1.990 GHZ.
Figure 5G:
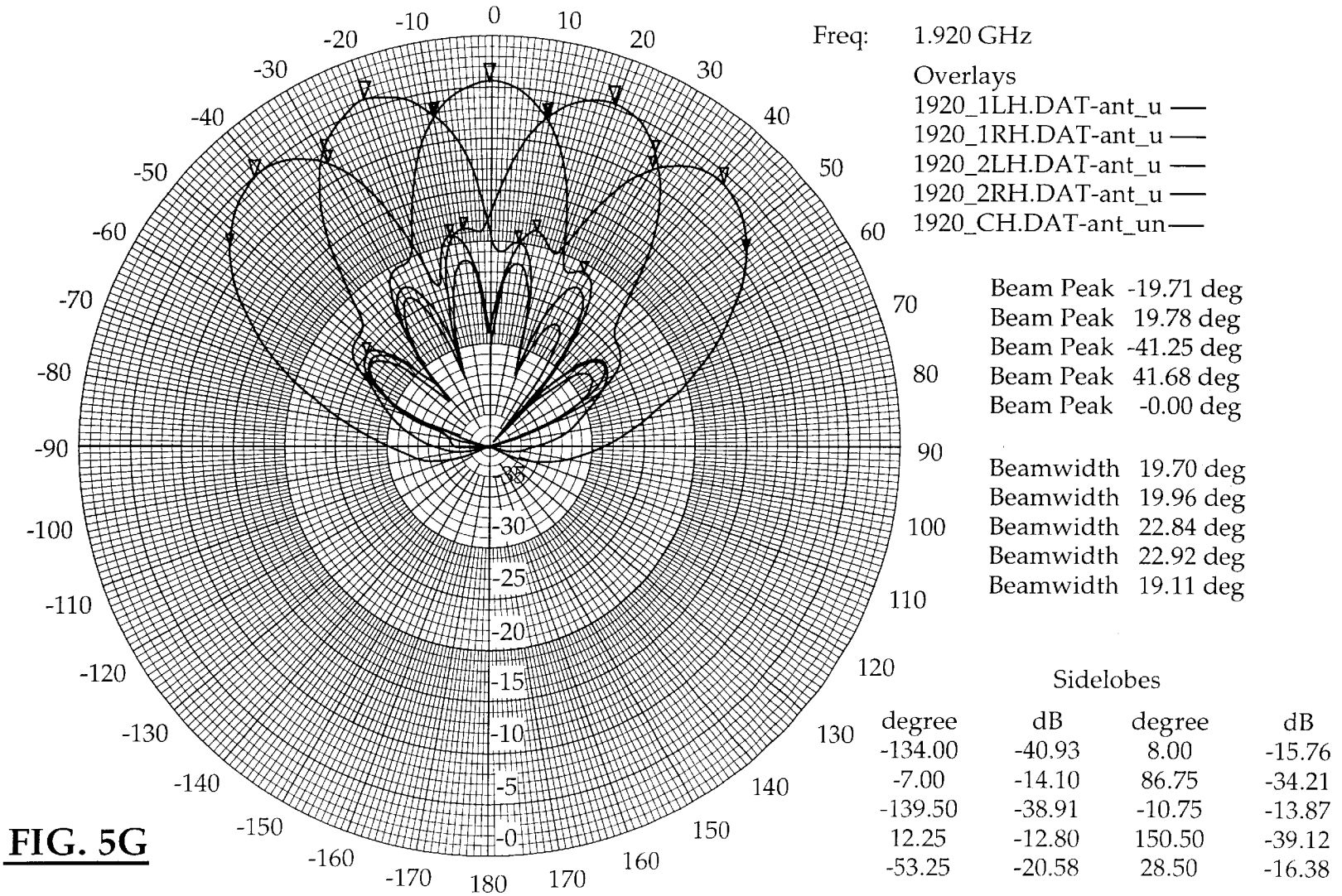
Figure 5H:
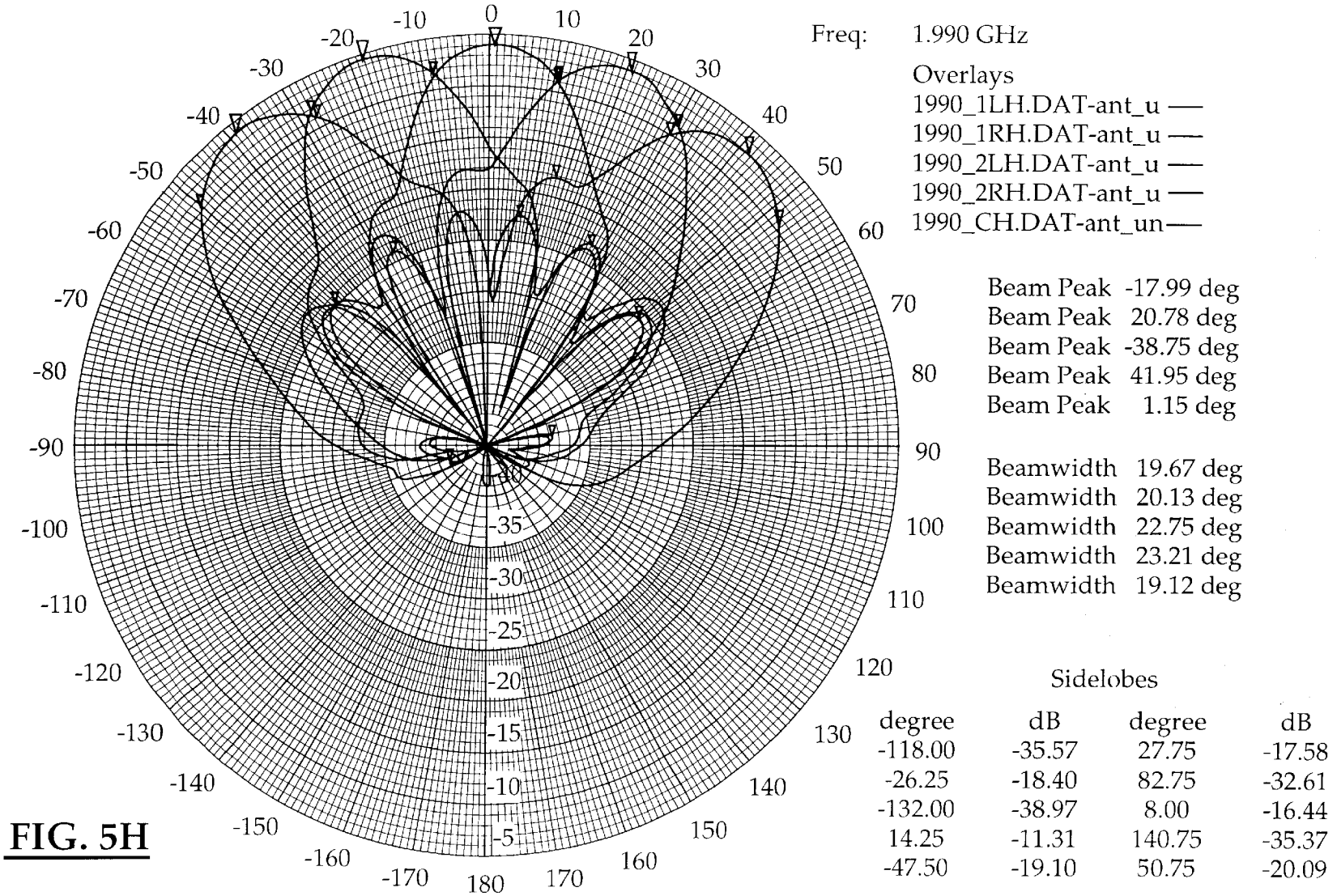

FIGS. 5F, 5G, 5H show frequency plots for the antenna in FIG. 5E respectively at frequencies of 1.850 GHz, 1.920 GHz and 1.990 GHZ. As a person skilled in the antenna design art would appreciate, each plots shows various plot characteristics, including three our plot overlays (i.e. 1L, 1R, CH), three beam peaks in degrees, three beamwidths in degrees, three f/b ratios in dB and four sidelobes in degrees and dBs. In FIGS. 5F, 5G, 5H, the various "triangles" help to indicate these various plot characteristics.

Figure 6A:
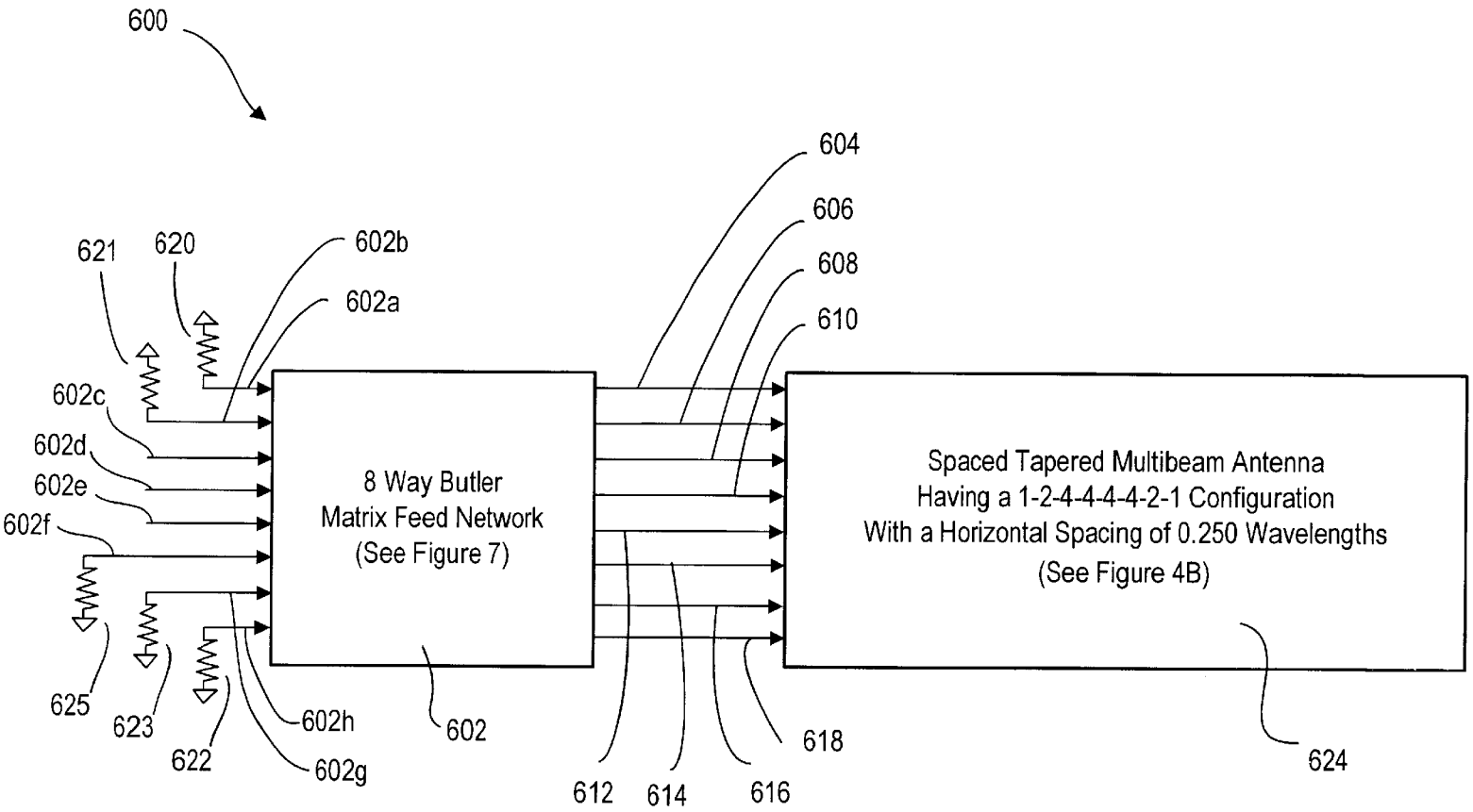
FIG. 6A shows a block diagram of an antenna that is the subject matter of the present invention.

Space Tapered 90° Multibeam Antenna with Three 30° Beams and Suppressed Side-lobes FIG. 6A shows a ninety degree antenna generally indicated as 600 having an 8-way Butler matrix feed network 402, having a space tapered multibeam antenna 626 with a 1-2-4-4-4-4-2-1 configuration and a horizontal spacing of 0.250 λ, and also having eight cables 604, 606, 608, 610, 612, 614, 616, 618 with the different cable lengths for connecting the 8-way Butler matrix feed network 602 to the space tapered multibeam antenna 624 to provide twenty two and a half degree phase progression. The ninety degree antenna 600 provides three thirty degree beams.

In effect, the antenna works with the principles used on the original four beam antenna. Instead of four rows of dipoles there are eight rows. When hooked up to an eight way Butler matrix, eight fifteen degree beams are normally formed. For the present invention, the eight rows were squeezed into the space normally occupied by four rows, together with twenty two and a half degree phase progression in the cabling, for providing three thirty degree beams.

This gives the antenna a horizontal spacing of 0.250 wavelengths. To get a centered beam, the equally phased cables leading from the Butler to the antenna were replaced with cables having a twenty two and a half degree phase progression. This gives one beam down the middle and one on either side. This could also be done by adding the phase progression directly to the Butler's outputs.

In order to achieve further side-lobe suppression, a space taper technique is used. The eight rows of dipoles do not have an equal number of elements. The 1-2-4-4-4-4-2-1 configuration supplies a side-lobe suppression of −17 dB. This antenna is also much broader banded than the original four beam model. It has a working bandwidth of 280 MHz as opposed to the normal 140 MHz.

The 8-way Butler matrix feed network 602 is known in the art, shown and described with respect to FIG. 7 of U.S. Pat. No. 5,589,843, and is connected to a radio receiver and/or transmitter (not shown) such as 37 shown in FIG. 1A. As shown, the 8-way Butler matrix feed network 602 has eight input ports 602*a*, 602*b*, 602*c*, 602*d*, 602*e*, 602*f*, 602*g*, 602*h*. Only three of the eight input ports 602*c*, 602*d*, 602*e* receive antenna input signals from the radio receiver and/or transmitter (not shown). The other five input ports 602*a*, 602*b*, 602*f*, 602*g*, 602*h* are connected via a respective resistor 620, 621, 622, 623, 625 to electrical ground. In one embodiment, the respective resistors 620, 621, 622, 623, 625 are 50 ohm resistors, although the scope of the invention is not intended to be limited to any particular resistor value.

The phase progression of the 8-way Butler matrix feed network 602 is as follows:

| | ANT1 | ANT2 | ANT3 | ANT4 | ANT5 | ANT6 | ANT7 | ANT8 |
|---|---|---|---|---|---|---|---|---|
| BEAM 2L | 0 | −67.5 | −135 | +157.5 | +90 | +22.5 | −45 | −112.5 |
| BEAM 1L | 0 | −22.5 | −45 | −67.5 | −90 | −112.5 | −135 | −167.5 |
| BEAM 1R | 0 | +22.5 | +45 | +67.5 | +90 | +112.5 | +135 | +167.5 |
| BEAM 2R | 0 | +67.5 | +135 | −157.5 | −90 | −22.5 | +45 | +112.5 |

As shown, the eight cables 604, 606, 608, 610, 612, 614, 616, 618 provide eight Butler matrix feed network signals to the space tapered multibeam antenna 624.

When the cables 604, 606, 608, 610, 612, 614, 616, 618 have a phase progression of 0, +22.5, +45, +67.5, +90, +112.5, +135, +157.5 together with the phase progression of the Butler matrix, then the ninety degree antenna 600 provides three thirty degree beams at the following angles:

| BEAM | ANT1 | ANT2 | ANT3 | ANT4 | ANT5 | ANT6 | ANT7 | ANT8 |
|---|---|---|---|---|---|---|---|---|
| 1L | 0 | −45 | −90 | −135 | −180 | +135 | +90 | +45 |
| C | 0 | 0 | 0 | 0 | 0 | 0 | 0 | 0 |
| 1R | 0 | +45 | +90 | +135 | +180 | −135 | −90 | −45 |

The sixty degree antenna 600 also provides a fourth unused beam.

Figure 6B:
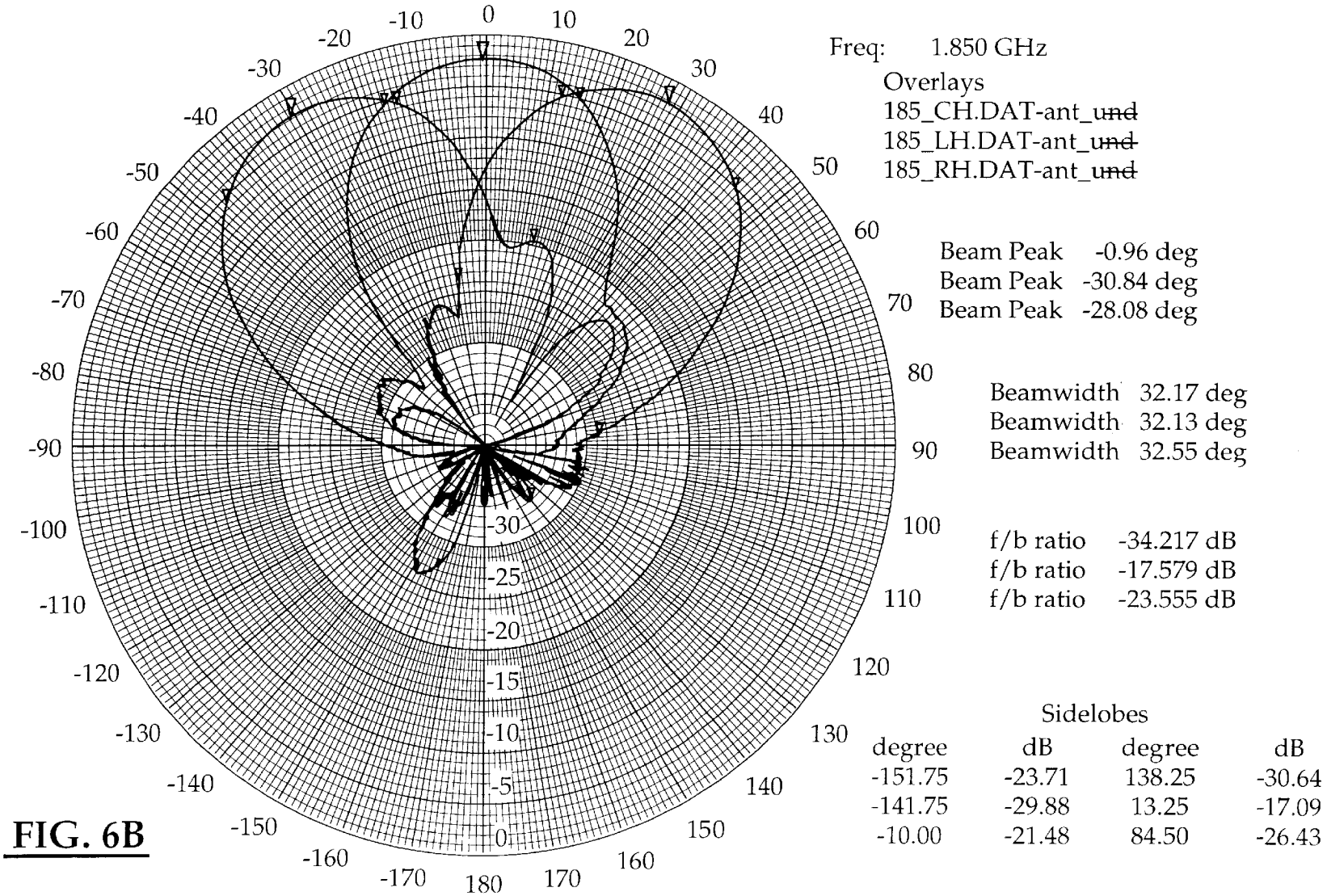
FIGS. 6B, 6C, 6D show frequency plots for the antenna in FIG. 6A respectively at frequencies of 1.850 GHz, 1.920 GHz and 1.990 GHZ.
Figure 6C:
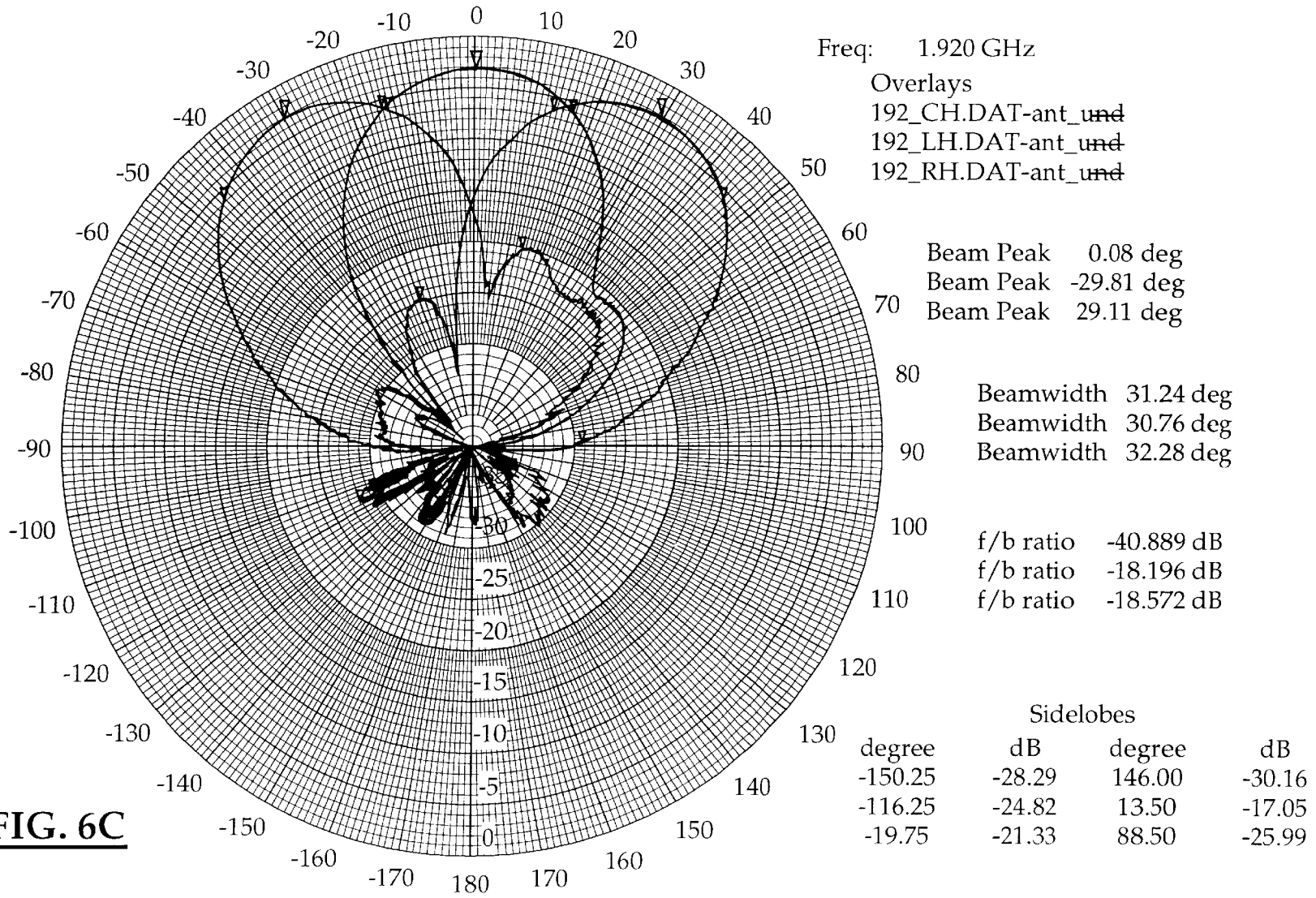
Figure 6D:
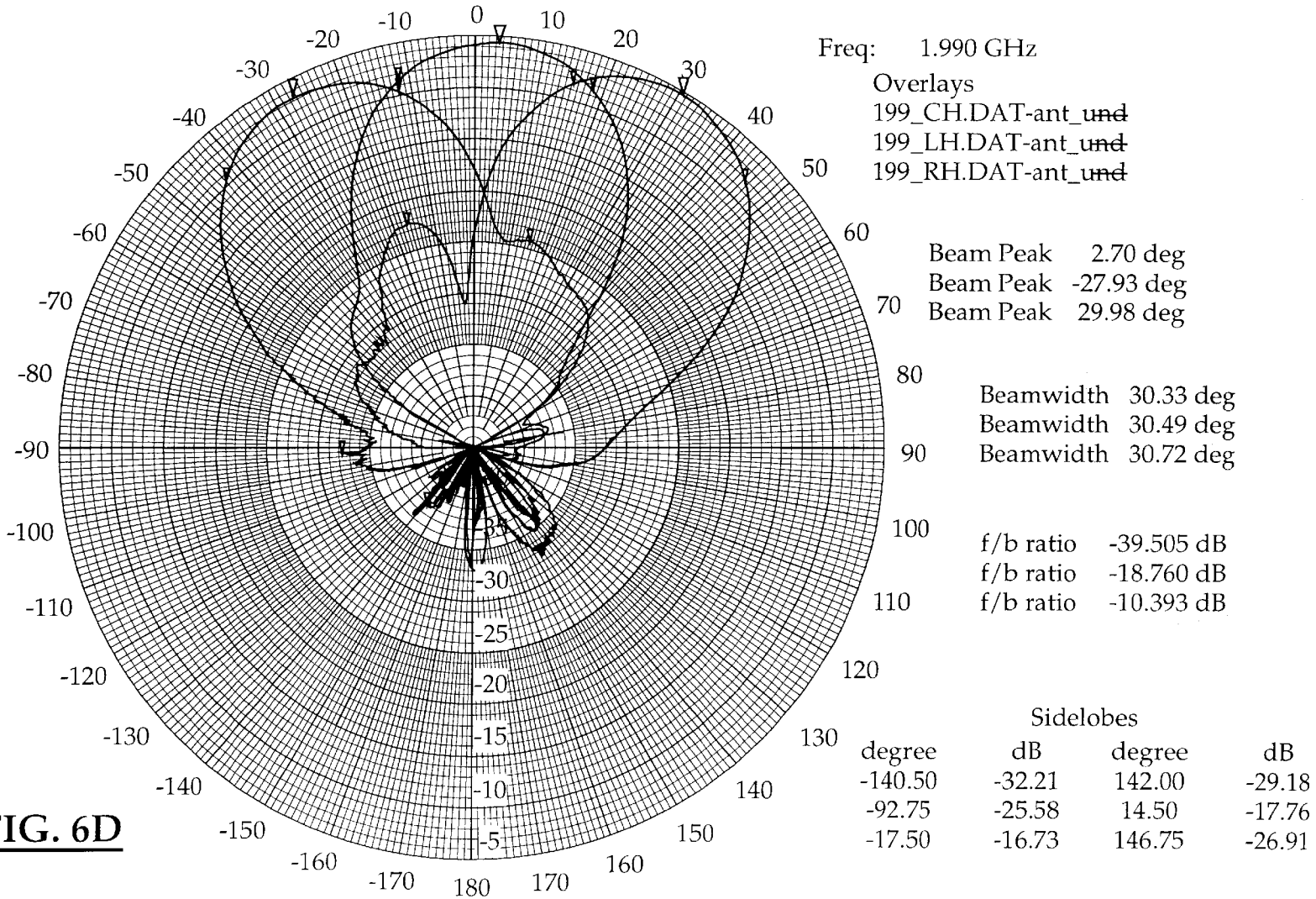

FIGS. 6B, 6C, 6D, show frequency plots for the antenna in FIG. 6A respectively at frequencies of 1.850 GHz, 1.920 GHz and 1.990 GHZ. As a person skilled in the antenna design art would appreciate, each plot shows various plot characteristics, including three plot overlays (i.e. 1L, 1R, CH), three beam peaks in degrees, three beamwidths in degrees, three f/b ratios in dB and four sidelobes. In FIGS. 6B, 6C, 6D, the various "triangles" help to indicate these various plot characteristics.

The suppressed side-lobe ninety degree antenna has side-lobe suppression better than −17 dB. The outer beams do not have the gain drop off associated with the one hundred twenty degree antenna as shown in the frequency plots in FIGS. 6B, 6C, 6D.

Figure 1C:
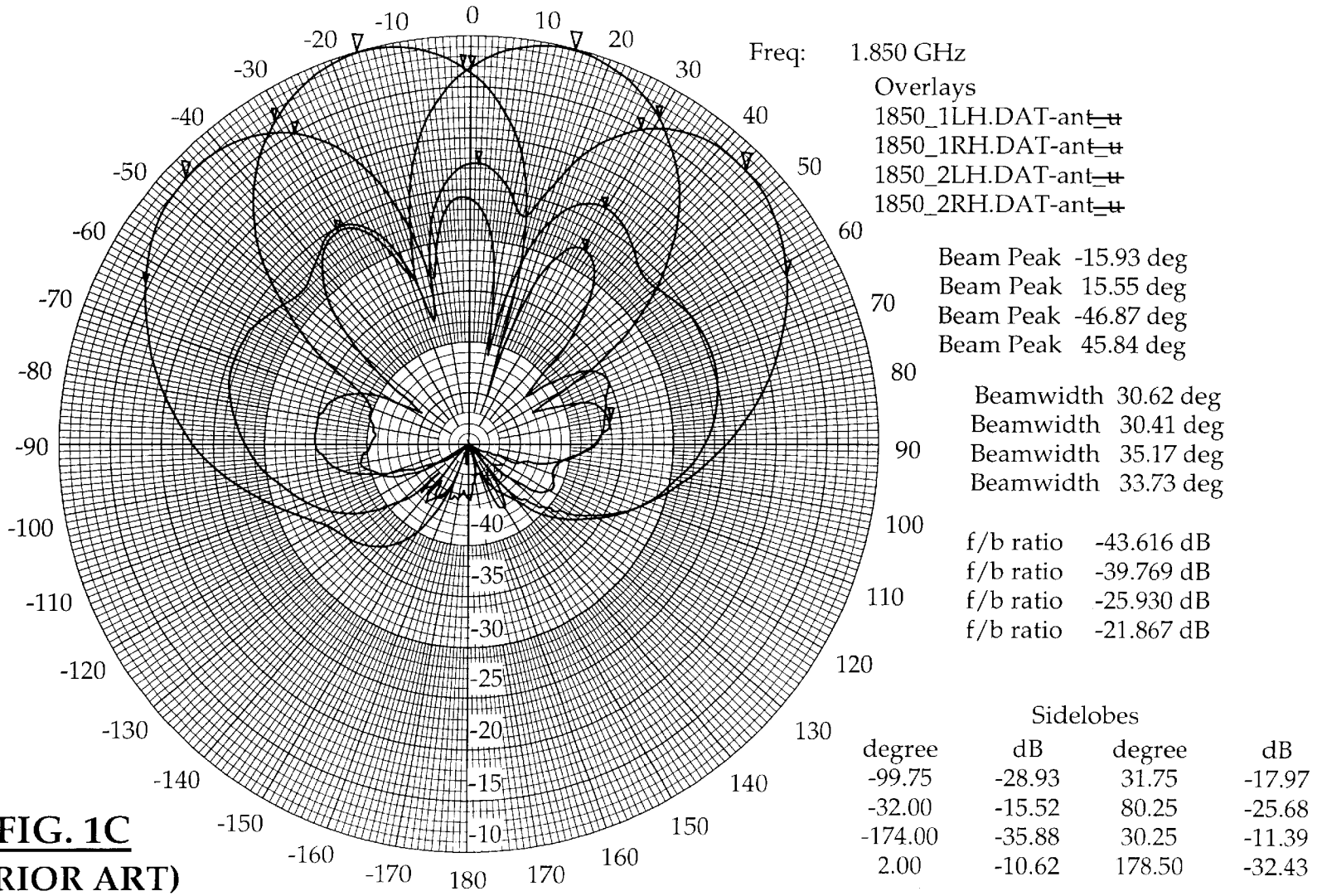
FIG. 1C (PRIOR ART)
Figure 1D:
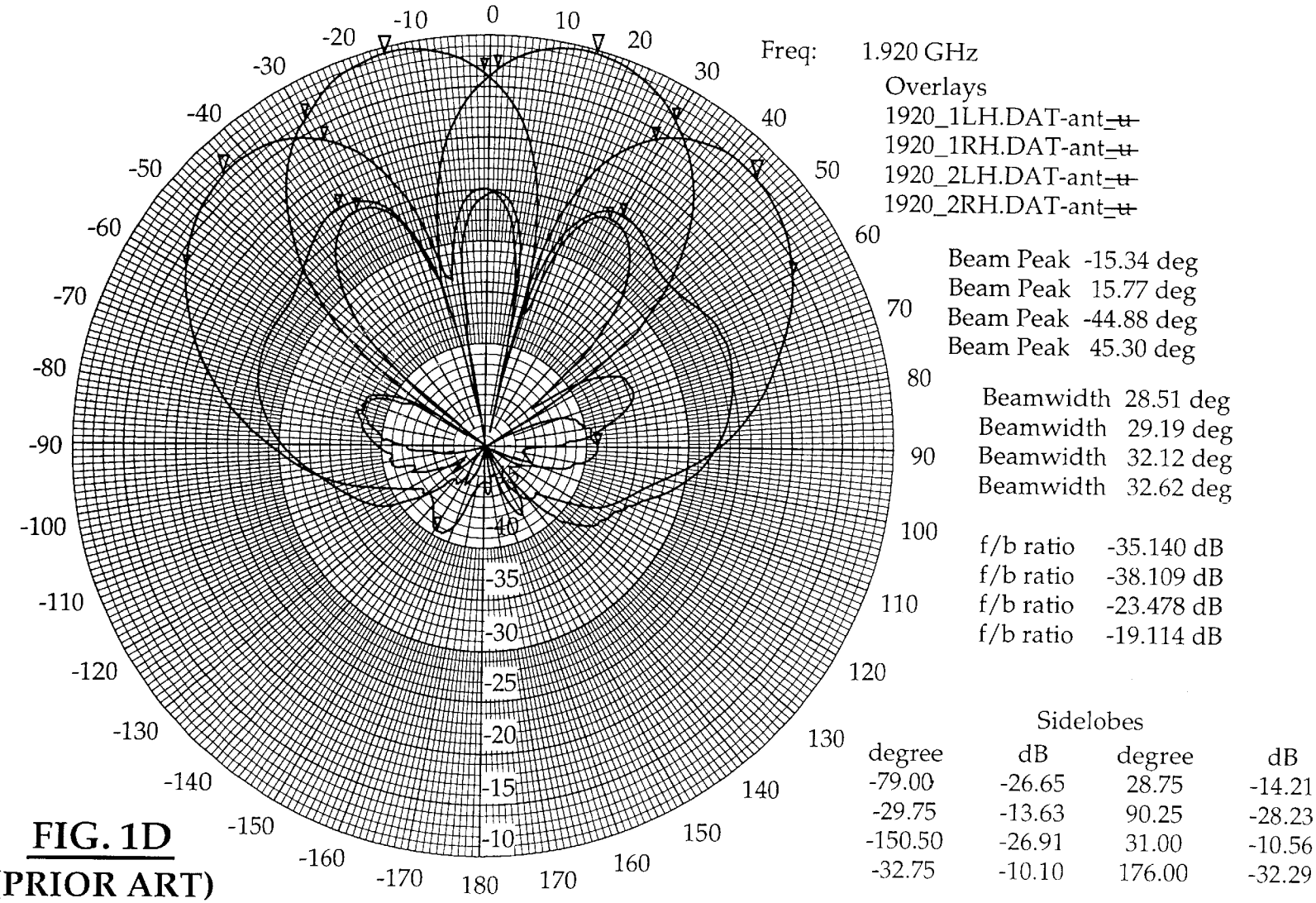
FIG. 1D (PRIOR ART)
Figure 1E:
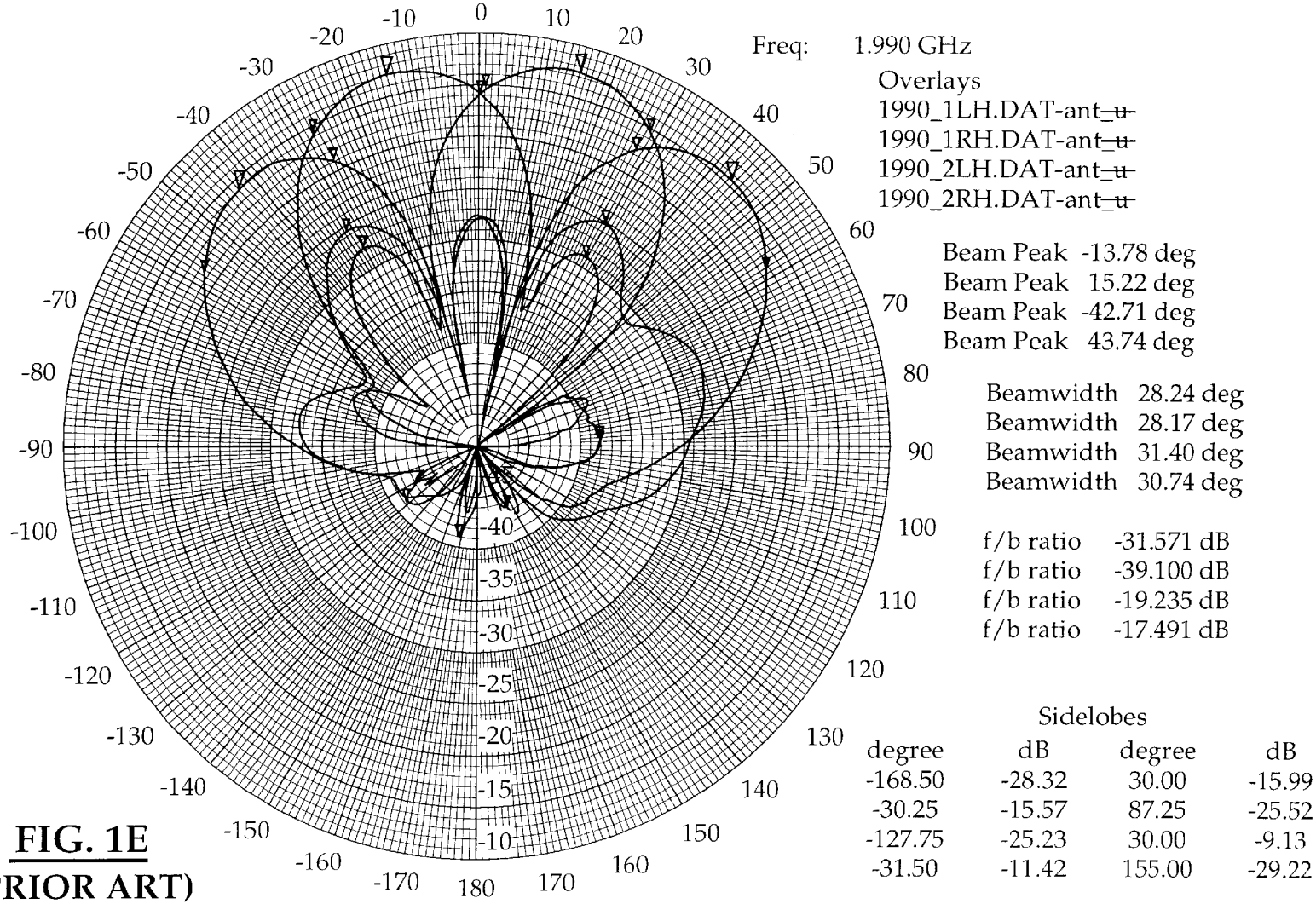
FIG. 1E (PRIOR ART)

The prior art space tapered one hundred twenty degree antenna having four thirty degree beams suffers from high side-lobe levels that do not meet the customer specification of being below −10 dB from the beam peak. Also, the outer beams suffer from a drop in gain as compared to the inner beams. See frequency plots in FIGS. 1C, 1D, 1E which show these problems. The normal ninety degree antennas with four rows of dipoles have side-lobe suppression of −12 dB as shown in FIGS. 1C, 1D, 1E.

A normal antenna with half wavelength spacing between the dipoles would have eight usable beams. Due to the compressed spacing, only four beams are usable. Also, half of the feedlines are on the back side of the reflector. This means the feedlines on the front side of the reflector are two half wavelengths long. For proper side-lobe suppression, an antenna needs to have feedlines which are an even number of half wavelengths long.

The ninety degree antenna 600 can be used wherever the original four beam antenna is used.

FIG. 7 illustrates the layout of the microstrip printed circuit board implementation of a Butler matrix feed network 128 used for connection with the antenna 224 shown in FIG. 3A. The ports 29 are identified with the 4L, 3L, 2L, 1L, 1R, 2R, 3R, 4R notation corresponding to the co-linear array connections with the ports 31 for connection to the radio receiver(s) and/or transmitter(s) having a similar notation.

SCOPE OF THE INVENTION

Accordingly, the invention comprises the features of construction, combination of elements, and arrangement of parts which will be exemplified in the construction hereinafter set forth.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the invention is intended to be claimed in a regular utility application to cover all of the generic and specific features of the invention herein described, and all statements of the scope of the invention which, as a matter of language, might be said to fall therebetween.

What is claimed is:

1. An antenna, comprising:

a radio receiver/transmitter;

a Butler matrix feed system coupled to the radio receiver/transmitter by a cable feeding system;

a collinear array having rows of radiating elements spaced at ½ λ and being coupled to the Butler matrix feed system;

characterized in that either the collinear array has compressed rows of radiating elements spaced apart in a range of ¼ λ to ⅜ λ, where λ is the operating wavelength of the antenna, or the cable feeding system is a phase progression cable feeding system, or a combination of both.

2. A space tapered multi-beam antenna according to claim 1, characterized in that the antenna is a 120° space-tapered antenna having eight compressed rows spaced at ⅜ λ for providing six 20° degree beams.

3. A space tapered multi-beam antenna according to claim 1, characterized in that the antenna is a 120° space-tapered antenna having eight compressed rows spaced at ¼ λ for providing four 30° beams.

4. A space tapered multi-beam antenna according to claim 1, characterized in that the antenna is a 60° space-tapered antenna having eight compressed rows spaced at ⅜ λ and the cable feeding system is a 22 ½° phase progression cable feeding system for providing three 20° beams.

5. A space tapered multi-beam antenna according to claim 1, characterized in that the antenna is a 90° space-tapered antenna having eight compressed rows spaced at ¼ λ and the cable feeding system is a 22 ½° phase progression cabling feeding system for providing three 30° beams.

6. A space tapered multi-beam antenna according to claim 1, characterized in that the antenna is a 90° space-tapered antenna having four rows spaced at ½ λ and the cable feeding system is a 45° phase progression cabling feeding system for providing three 30° beams.

7. An antenna system, comprising:

an N by N butler matrix, responsive to X input signals, where X is an integer greater than 1 and less than N, for providing N butler matrix signals; and a multibeam antenna, responsive to the N butler matrix signals, for providing Y multibeam antenna signals, where Y is an integer greater than 1 and less than N.

8. An antenna system according to claim 7, wherein the antenna system has N cables for coupling the N by N butler matrix to the multibeam antenna; and wherein each of the N cables has a different length for providing a phase progression in the N butler matrix signals.

9. An antenna system according to claim 7, wherein the multibeam antenna has N collinear arrays having compressed spacing therebetween.

10. An antenna system according to claim 7, wherein the less than N multibeam antenna signals include N−1 multibeam antenna signals.

* * * * *